US005272865A

United States Patent [19]

Sasaki et al.

[11] Patent Number: 5,272,865

[45] Date of Patent: Dec. 28, 1993

[54] METHOD AND APPARATUS FOR EXCHANGING ROVING BOBBINS IN A RING SPINNING FRAME

[75] Inventors: Kenji Sasaki, Komaki; Kazuo Yamada, Inazawa; Hiroshi Sugimoto, Kounan, all of Japan

[73] Assignee: Howa Machinery, Ltd., Aichi, Japan

[21] Appl. No.: 762,941

[22] Filed: Sep. 19, 1991

[30] Foreign Application Priority Data

Nov. 5, 1990 [JP] Japan ..... 2-300506
May 30, 1991 [JP] Japan ..... 3-155415

[51] Int. Cl.[5] ..... D01H 9/18; D01H 9/00

[52] U.S. Cl. ..... 57/281; 57/90; 57/261; 57/268; 57/270; 57/276

[58] Field of Search ..... 57/90, 281, 261, 268, 57/270, 276

[56] References Cited

U.S. PATENT DOCUMENTS

| | | | |
|---|---|---|---|
| 4,799,353 | 1/1989 | Kawasaki et al. | 57/276 X |
| 4,841,720 | 6/1989 | Kawasaki et al. | 57/268 X |
| 4,845,935 | 7/1989 | Mack | 57/261 |
| 4,899,531 | 2/1990 | Mack | 57/281 |
| 5,099,641 | 3/1992 | Igel et al. | 57/90 X |

FOREIGN PATENT DOCUMENTS

| | | | |
|---|---|---|---|
| 0258188 | 3/1988 | European Pat. Off. . | |
| 0310871 | 4/1989 | European Pat. Off. . | |
| 62-53425 | 3/1978 | Japan . | |
| 61-1533 | 1/1986 | Japan | 57/281 |
| 1-192837 | 8/1989 | Japan | 57/90 |
| 2-127368 | 5/1990 | Japan . | |

*Primary Examiner*—Daniel P. Stodola
*Assistant Examiner*—William Stryjewski
*Attorney, Agent, or Firm*—Stevens, Davis, Miller & Mosher

[57] ABSTRACT

A method and apparatus for carrying out a roving bobbin exchange operation when applied to a conventional ring spinning frame. The roving bobbin exchange operation is simultaneously carried out on a plurality of successive pairs of a front bobbin hanger and a back bobbin hanger of the creel portion of the spinning frame by intermittently displacing the operation unit along the spinning frame and by utilizing a plurality of pairs of a first sub-peg unit having a front peg and a back peg, and a second sub-peg unit having a front peg and a back peg unit, whereby a roving bobbin mounted on the front peg of the first sub-peg unit can be transferred to the back peg of the second sub-peg unit, and vice versa, during the exchange operation, and thus the unit roving bobbin exchange operation can be carried out in a very limited space defined by twice a pitch between two adjacent pairs of a front bobbin hanger and a back bobbin hanger facing the first bobbin hanger.

18 Claims, 32 Drawing Sheets

METHOD AND APPARATUS FOR EXCHANGING ROVING BOBBINS IN A RING SPINNING FRAME

BACKGROUND OF THE INVENTION

1. Field of the Invention

The present invention relates to a method and apparatus for exchanging roving bobbins in a ring spinning frame, and more particularly relates to an improved method and apparatus for exchanging roving bobbins in a ring spinning frame during a continuous spinning operation thereof.

2. Description of the Related Art

When roving bobbins which are supplying rovings to draft parts of a ring spinning frame become almost exhausted, such almost exhausted roving bobbins, which are supported by the bobbin hangers arranged in the ring spinning frame, should be exchanged with full packaged roving bobbins, to enable a continuous spinning operation of the ring spinning frame. Recently, however, there is a tendency for the roving bobbin exchange operation to be carried out by using an automatic roving bobbin exchange apparatus, because of the difficulty in handling large packaged roving bobbins, which weigh as much as three kgs. Accordingly, several types of automatic apparatuses for exchanging the roving bobbins have been introduced in the spinning industries of many countries.

One such automatic apparatus for carrying out the roving bobbin exchange operation is disclosed in Japanese Unexamined Patent Publication No. 62-53425. This prior art document disclosed that, when the roving bobbins supported by a front row of bobbin hangers in a ring spinning frame become almost exhausted, each of these almost exhausted roving bobbins is exchanged with a corresponding full packaged roving bobbin prepared at a standby position on a supplemental rail arranged along and in front of the ring spinning frame, and the full packaged roving bobbins supported by the corresponding front row of bobbin hangers are exchanged with the corresponding almost half exhausted roving bobbins supported by a back row of bobbin hangers in the ring spinning frame, by using an automatic roving bobbin exchange apparatus.

Japanese Unexamined Patent Publication No. 2-127368 also discloses an apparatus for carrying out an automatic roving bobbin exchange method to be applied to a ring spinning frame, wherein a tapered arrangement of roving bobbins is applied as described hereafter. Namely, at the start of the spinning operation, two types of roving bobbins, i.e., an almost half exhausted roving bobbin, and a full packaged roving bobbin, are alternately supported by a front and back row of bobbin hangers in the ring spinning frame. In the roving bobbin exchange operation, a pair of almost exhausted roving bobbins, one of which is a roving bobbin supported by a bobbin hanger of the front row and the other is a roving bobbin supported by a bobbin hanger of the back row and facing the bobbin hanger of the front row, are exchanged with a pair of fully packaged roving bobbins supported by two adjacent bobbin hangers of a bobbin carriage prepared on a supplemental bobbin rail arranged along and in front of the ring spinning frame. The automatic roving bobbin exchange operation is carried out successively along the ring spinning frame until the roving bobbin exchange operation of all of the almost exhausted roving bobbins of one side of the ring spinning frame is completed. Therefore, in this automatic apparatus for carrying out the roving bobbin exchange method, it is essential to arrange a device for transferring almost exhausted roving bobbins and having a pair of pegs and a device for transferring full package roving bobbins and also having a pair of pegs in parallel on a body of the roving bobbin exchange apparatus, wherein the pitch between the row of the pegs of the transfer device for the almost exhausted roving bobbins and the row of the pegs of the transfer device for the full packaged roving bobbins is equal to the pitch of bobbin hangers of the front and back rows in the ring spinning frame, and accordingly, it is necessary to provide a space in which the above-mentioned two devices may be arranged in the lengthwise direction of the ring spinning frame. This space corresponds to the space for four bobbin hangers, i.e., two adjacent bobbin hangers of the front row and two adjacent bobbin hangers of the back row facing the two bobbin hangers of the front row. Japanese Unexamined Patent Publication No. 2-127368 also discloses an automatic roving bobbin exchange apparatus in which the above-mentioned invention is modified by combining a roving piecing device therewith.

In the first-mentioned prior art, since the roving bobbin exchange operation is simultaneously applied to two or more roving bobbins, the time needed for completing the roving bobbin exchange operation can be remarkably reduced in comparison with that of the second mentioned prior art. Nevertheless the application of the first mentioned prior art is limited to only a ring spinning frame provided with an apparatus for exchanging a roving bobbin and carrying out such an exchange between the bobbin hanger of the front row and a roving bobbin hanger of the back row facing the above-mentioned bobbin hanger of the front row. The second mentioned prior art has an advantage of being able to be applied to a ring spinning frame without the need for the above-mentioned roving bobbin exchange apparatus, which is essential to the first mentioned prior art, but the time needed for completing the roving bobbin exchange operation is much longer, in comparison with that of the first mentioned prior art, because of the transfer of two almost exhausted roving bobbins and of two full packaged roving bobbins. Therefore, for the above-mentioned reasons, the roving bobbin exchange operations based upon the first and second mentioned prior arts are not satisfactory.

To eliminate the above-mentioned problems, in the above-mentioned second invention, for example, an improvement such that a plurality of sets of a unit combination of the almost empty roving bobbin exchange device and the full package roving bobbin exchange device are mounted on the automatic roving bobbin exchange apparatus, to thereby simultaneously carry out the roving bobbin exchange operation for a plurality of sets of almost exhausted roving bobbins could. Here, each set of almost exhausted roving bobbins would consist of an almost exhausted roving bobbin supported by a bobbin hanger of the front row and an almost exhausted roving bobbin supported by a bobbin hanger of the back row facing the bobbin hanger of the front row, with the respective full packaged roving bobbins supported by the corresponding bobbin hangers of the bobbin carriage supported by the supplemental rail. Such a modification of the second mentioned invention is not practical, however because of the resulting mechanical complications of the constituent machine elements and interferences occurring due to the motions of these machine elements.

SUMMARY OF THE INVENTION

Therefore, the object of the present invention is to provide a method and apparatus for simultaneously exchanging a plurality of pairs of almost exhausted roving bobbins, wherein each pair of almost exhausted roving bobbins consists of an almost exhausted roving bobbin of the front row and an almost exhausted roving bobbin of the back row facing the almost exhausted roving bobbin of the front row, with full packaged roving bobbins supported by the corresponding bobbin hangers of the bobbin carriage carried to a transfer position on the supplemental rail. Another object of the present invention is to provide an improved method and an apparatus for carrying out the roving bobbin exchange operation in a very stable condition, which is applied to a ring spinning frame having creel row arranged at a comparatively lower position than in the conventional ring spinning frame.

To attain the object of the present invention, the roving bobbin exchange operation is carried out by an improved apparatus which has a function of simultaneously carrying out a plurality of roving bobbin exchange operations on pairs of bobbin hangers which need the roving bobbin exchange operation, by displacing along the lengthwise direction of a ring spinning frame by a predetermined displacing pitch defined by the number of above-mentioned pairs of bobbin hangers of the creel portion of the spinning frame to which the unit roving bobbin exchange operations are applied.

According to the basic technical idea of the roving bobbin exchange operation of the present invention, in each unit operation thereof, a pair of full packaged roving bobbins FB, which corresponds to a pair of almost exhausted roving bobbins SB supported by the corresponding pair of a front and back bobbin hanger of the creel portion of the spinning frame, are transferred to a roving bobbin exchanging apparatus, then one of the above-mentioned pair of full packaged roving bobbins FB is displaced to a position in front or back of the other full packaged roving bobbin FB with respect to the apparatus, then the above-mentioned almost exhausted roving bobbins SB are taken from the bobbin hangers of the creel portion of the spinning frame and displaced to positions adjacent to the above-mentioned row of full packaged roving bobbins FB on the apparatus, thereafter the full packaged roving bobbins FB which have been changed in their arrangement are mounted on the above-mentioned pair of bobbin hangers from which the almost exhausted roving bobbins have been taken off, then the arrangement of the almost exhausted roving bobbins is changed to an arrangement in the lengthwise direction of the spinning frame while these almost exhausted roving bobbins are positioned on the apparatus, thereafter these almost exhausted roving bobbins are mounted on the two adjacent bobbin hangers SB of the supplemental rail from which the above-mentioned full packaged roving bobbins FB have been take off. The above-mentioned unit operation is simultaneously applied to a plurality of successive pairs of bobbin hangers holding almost exhausted roving bobbins while the apparatus is stopped at its unit working position. After completion of the operation, the apparatus is displaced by one pitch along the lengthwise direction of the ring spinning frame. Such a stepwise operation is repeated until all the almost exhausted roving bobbins supported by the bobbin hangers of a creel portion of one side of the spinning frame are exchanged.

To effectively carry out the above-mentioned operation, a supplemental step of temporarily reserving a roving bobbin in the apparatus can be applied. Some further modification of the roving bobbin exchanging operation regarding the displacement of the apparatus along the lengthwise direction of the spinning frame by one pitch corresponding to a pitch between adjacent two bobbin hangers of the front (back) row thereof, during the unit operation, are possible too.

It is also possible to use a peg unit comprising a pair of sub-peg units provided with two pegs for supporting roving bobbins and having a main function of changing the arrangement direction of these two pegs between two directions; a direction along the lengthwise direction of the spinning frame and a direction perpendicular to the above-mentioned direction. Each of these sub-peg units is provided with a function to displace the roving bobbins between a creel position below the corresponding pair of bobbin hangers to which the roving bobbin exchange operation is required and a standby position on the apparatus. Other supplementary mechanisms such as a mechanism to displace the sub-peg units upward and downward, a roving piecing mechanism, and a device for temporarily reserving a roving bobbin on the apparatus, may be adopted to improve the function of the roving bobbin exchange apparatus according to the present invention.

DESCRIPTION OF THE PREFERRED EMBODIMENTS

The mechanism and function of a first embodiment of a roving bobbin exchange apparatus according to the present invention are explained in detail with reference to the drawings shown in FIGS. 1 to 31.

In the following explanation, for better understanding, the direction transverse to the lengthwise direction of a ring spinning frame is simply indicated as the transverse direction. The outside position and inside position with respect to the center row along the lengthwise direction of the spinning frame are hereinafter indicated as the front position and back position, respectively.

Prior to the explanation of the first embodiment of the present invention, a ring spinning frame to which the present invention is applied is explained.

Figure 1:
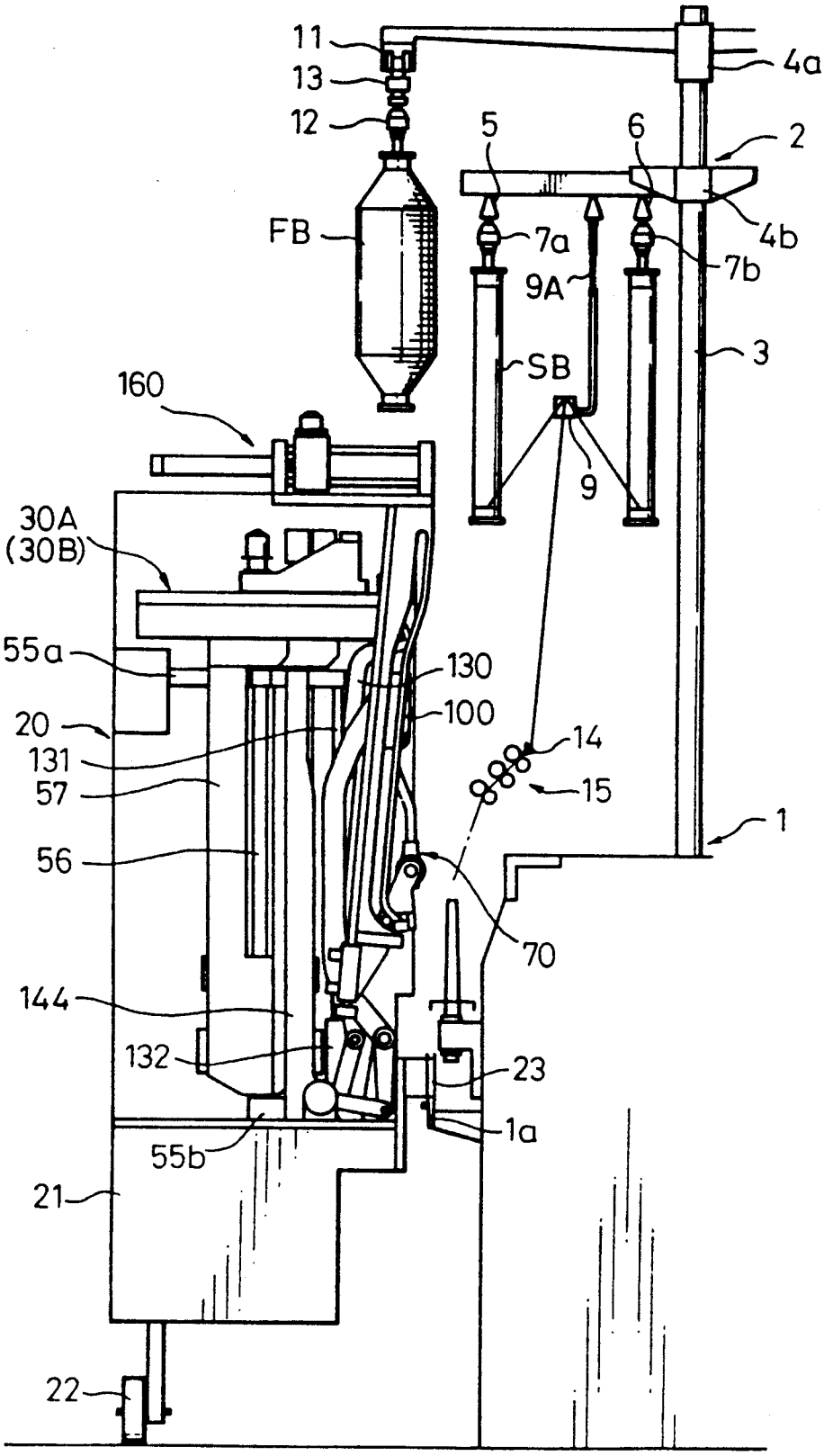
FIG. 1 is a side view of the roving bobbin exchange apparatus according to the present invention, positioned beside a ring spinning frame in a working condition.
Figure 24:
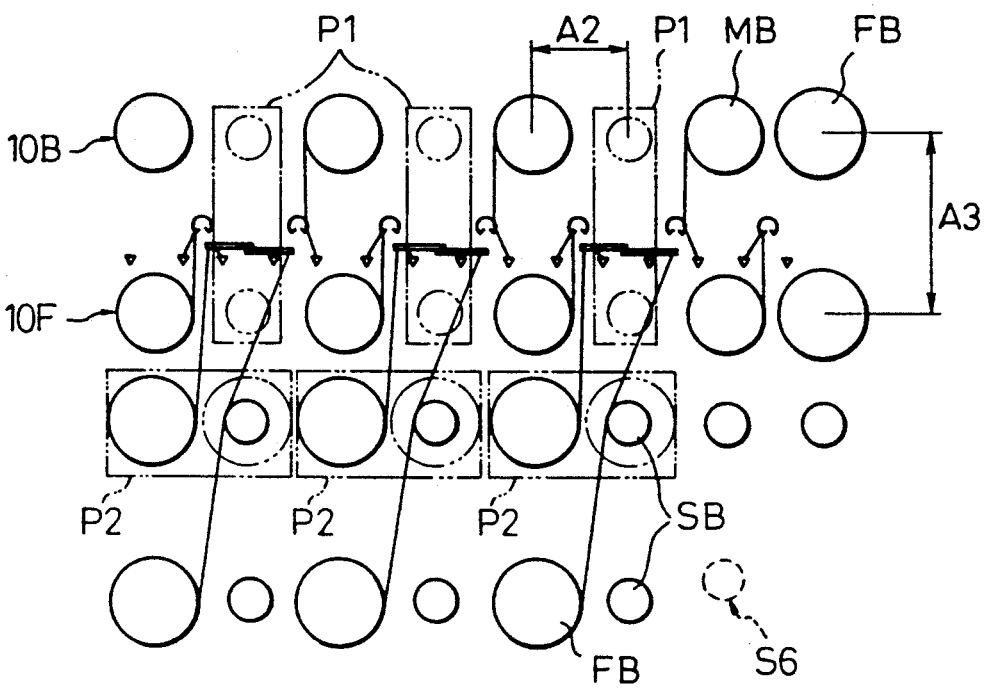
FIG. 24 is an explanatory view indicating the positional relationship between three sets of roving bobbins handled simultaneously by the apparatus shown in FIG. 1.
Figure 25:
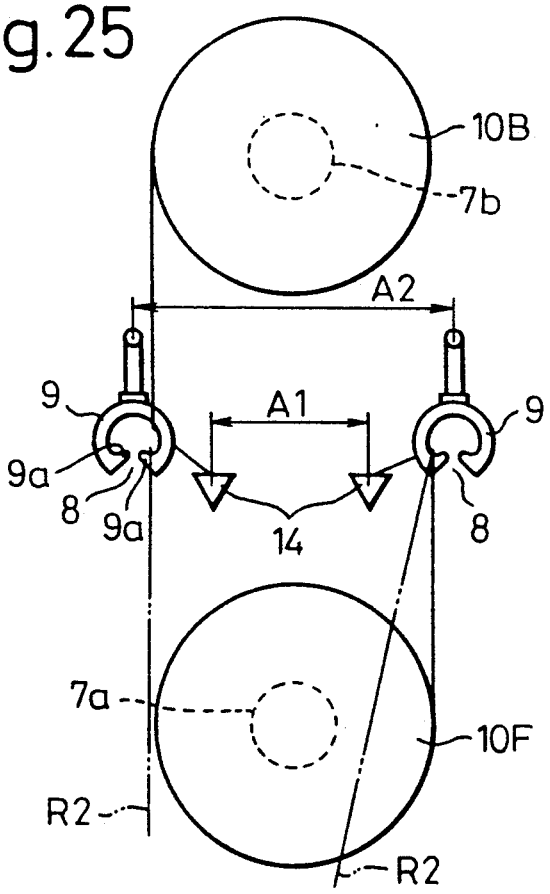
FIG. 25 is a plan view indicating the positional relationship between rovings and the roving guide elements.

As shown in FIG. 1, in a creel portion 2 of a ring spinning frame 1, a plurality of pillars 3 are vertically arranged along the lengthwise direction of the spinning frame 1 at a predetermined pitch therebetween, and a horizontal bracket 4*b* is rigidly supported by each creel pillar 3. At each side of the spinning frame, a pair of supporting rails 5 and 6, which extend in parallel along the lengthwise direction of the spinning frame 1, are rigidly supported by a corresponding one side portion of the horizontal brackets 4*b*. Namely, the front supporting rail 5 and the back supporting rail 6 are rigidly supported by the horizontal brackets 4*b* at each side of the spinning frame 1. At each side of the spinning frame 1, the front supporting rail 5 and the back supporting rail 6 are provided with a plurality of bobbin hangers (7*a* and 7*b*). The number of bobbin hangers 7 is one-fourth of the total number of spindles of the spinning frame 1. The pitch A2 between two adjacent bobbin hangers of the supporting rail 5 and that of the supporting rail 6 is double the pitch Al between two adjacent trumpets 14 which are utilized to introduce a roving into the corresponding draft parts 15 of the spinning frame. The relative positions of the roving bobbins (full packaged roving bobbins are indicated by FB and almost exhausted roving bobbins are indicated by SB) supported by the bobbin hangers 7 (not shown) in the ring spinning frame 1 are clearly shown in FIGS. 24 and 25. In FIG. 25, the arrangement of two roving guides 9 is shown in relation to the arrangement of two full packaged roving bobbins, one of which is a full packaged roving bobbin 10A supported by a front bobbin hanger 7A and the other of which is a full packaged roving bobbin 10B supported by a back bobbin hanger 7B facing the front bobbin hanger 7A. Namely, the roving guides 9 are arranged at intermediate positions between the rows of the front bobbin hangers 7A and the back bobbin hangers 7B along the lengthwise direction of the ring spinning frame 1. As shown in FIG. 25, each roving guide 9 is formed in the shape of the letter "C" having an opening 8 facing the front side of the spinning frame 1. The pitch between these two roving guides 9 is identical to the above-mentioned pitch A2. Each roving guide 9 is suspended from the corresponding supporting bracket 4*b* at respective positions between two adjacent supporting brackets 4*b*, by way of a spring element 9A, so that the roving guide 9 will not disturb the operation of the roving bobbin exchange operation because the roving guide 9 can move outward from the standby position thereof with respect to the above-mentioned full packaged roving bobbin FB, when the full packaged roving bobbin 10B is displaced toward the inside of the spinning frame 1, and the roving guides 9 are returned to their respective standby positions after the full packaged roving bobbin 10B has passed through the space therebetween. As shown in FIG. 24, in this embodiment, in each row of the bobbin hangers 7, full packaged roving bobbins FB and almost half exhausted roving bobbins MB are arranged alternately at the start of the spinning operation, and the size of each of the two roving bobbins supported by each pair of two bobbin hangers 7, one of which is a front bobbin hanger 7A and the other of which is a back bobbin hanger 7B facing the front bobbin hanger 7A, is identical. Each pair of bobbin hangers 7 is hereinafter referred to as a pair of bobbin hangers Pl.

Another supporting bracket 4*a*, provided with horizontal portions extended from the pillar 3 toward both front sides of the spinning frame 1, is rigidly mounted on the top end portion of each pillar 3, and a supplemental rail 11 having a rectangular cross-section is rigidly supported by the outer end portion of the supporting brackets 4*a* at each side of the spinning frame 1, such that the supplemental rail 11 is arranged along the lengthwise direction of the spinning frame at both sides of the spinning frame 1. The supplemental rail 11 is provided with a downward facing opening and is set at a position slightly higher than the level of the outer end of the supporting bracket 4*b*, in such a manner that the rail 11 is able to temporarily support a bobbin carriage 13 provided with a number of bobbin hangers 12 which is identical to or more than the number of bobbin hangers 7A in the front row thereof, a pitch A2 between each two adjacent bobbin hangers 12, at each side of the spinning frame 1.

Before starting the roving bobbin exchange operation, the bobbin carriage 13 supporting the full packaged roving bobbins FB on the bobbin hangers 13 is displaced toward the supplemental rail 11, and there awaits the roving exchange operation at a standby position at which the full packaged roving bobbins FB face the group of roving bobbins for which the roving bobbin exchange operation is to be carried out. In the first embodiment, the position of the supplemental rail 11 is such that, when the bobbin carriage 13 is carried to the standby position, the bottom ends of the roving bobbins are positioned below the upper ends of the roving bobbins moved from the bobbin hangers of the ring spinning frame onto the roving bobbin exchange apparatus.

The mechanism and function of the roving bobbin exchange apparatus 20 according to the first embodiment of the present invention is hereinafter explained in detail. In this embodiment, the apparatus 20 has a function of carrying out the roving piecing operation and a function of temporarily holding a roving bobbin to thereby prevent any interference between roving bobbins supported by the bobbin hangers 12 of the bobbin carriage 13 while at the standby position of the supplemental rail 11, and a roving bobbin moved by the apparatus 20. As shown in FIG. 1, the apparatus 20 is provided with a pair of wheels 22 rotatably disposed at respective positions below the main body 21 and a pair of guide rollers 23 rotatably disposed at respective positions of the main body 21, in such a manner that the guide rollers 23 are able to more along a horizontal guide rail 1*a* disposed lengthwise of the spinning frame 1. As in other known automatic apparatuses applied to known ring spinning frames, the apparatus 20 is displaced by engaging a scroll cam (not shown) driven by a drive motor (not shown) mounted on the apparatus 20 and guide pins (not shown) projected from the guide rail 1*a*, and the displacement of the apparatus 20 is regulated so that it is stopped at the respective working positions thereof.

The main body 21 of the apparatus 20 is provided with a plurality of peg units (in this embodiment, six peg units are utilized) 30A, 30B which are utilized for simultaneously exchanging almost exhausted roving bobbins SB supported by the respective bobbin hangers 7A, 7B and forming pairs Pl (shown in FIG. 24) with the full packaged roving bobbins FB supported by the corresponding bobbin hangers 12 of the bobbin carriage 12. In this embodiment, the roving bobbin exchange operation is simultaneously applied to three pairs Pl of the bobbin hangers 7A, 7B of the spinning frame. The apparatus 20 is also provided with a device 70 for taking a free end of roving from the plurality of full packaged roving bobbins FB supported by the respective peg units 30A and 30B, by air suction; a piecing device 100 for joining the free end of the roving taken by the device 70 with a free end of a corresponding roving taken from the corresponding almost exhausted roving bobbin for which the roving bobbin exchange operation is carried out and supplying it to a draft part which corresponds to the almost exhausted driving bobbin; a device 130 for hanging the rovings from the full packaged roving bobbins FB onto the corresponding roving guides 9; a device 160 for temporarily holding the full packaged roving bobbins FB taken from the bobbin hangers 12 of the bobbin carriage 13 while maintaining the pitch A2 between each two adjacent full packaged roving bobbins FB at the corresponding standby positions S6 (see FIG. 26), which position is separated from the position below the supplemental rail 11, (a bobbin reserve device 160 for temporarily reserving a full packaged bobbin at a pitch A2 at a standby position S6 (FIG. 26) away from the bobbin hanger 12 of the bobbin carriage 13*a* and away from directly under the supplemental rail 11); and means for driving the above-mentioned component devices.

Next, the mechanism and the function of the peg units 30A, and 30B are explained. In this embodiment, six peg units 30A and 30B are arranged alternately to hold the full packaged roving bobbins FB, and the almost exhausted roving bobbins SB from the side of the roving plates 31*a* and 31*b* are connected by a front block 31*c* and an intermediate block 31*e*, to thereby form a slide block 31. A pair of front pegs 32 are rotatably disposed on the front block 31*c*, and these front pegs 32 are rotated in both axial directions by corresponding reversible motors 33 through gear trains 34. As shown in FIG. 24, in this embodiment, in each row of the bobbin hangers 7, full packaged roving bobbins FB and almost half exhausted roving bobbins MB are alternately arranged at the start of the spinning operation, and the size of each of the two roving bobbins supported by each pair of two bobbin hangers 7, one of which is a front bobbin hanger 7A, and the other of which is a back bobbin hanger 7B facing the above-mentioned front bobbin hanager 7A, is identical. Each pair of bobbin hangers 7 is hereinafter referred to as a pair of bobbin hangers Pl.

Figure 5:
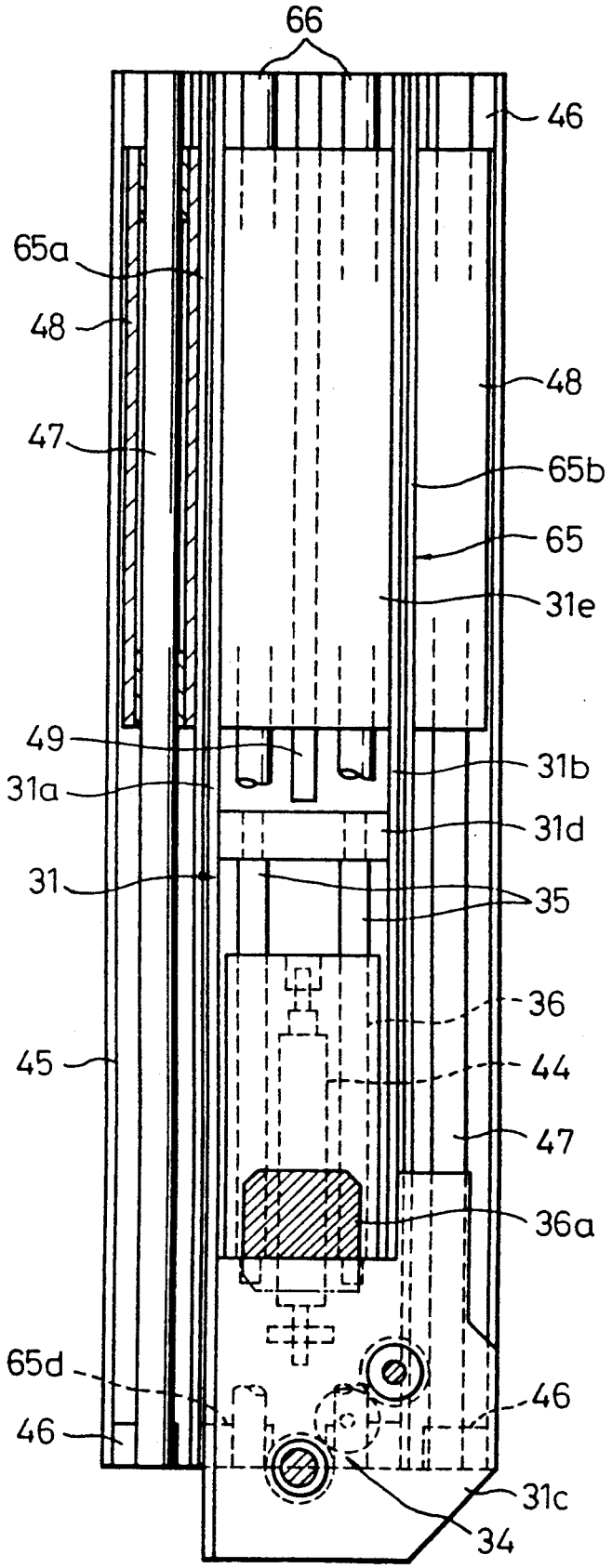
FIG. 5 is a cross-sectional view of the device shown in FIG. 7, taken along the row V—V.

As shown in FIG. 5, the front block 31*c* and the intermediate block 31*d* are connected by a pair of horizontal guide rods 35 extended perpendicularly to the lengthwise direction of the spinning frame 1, and a supporting body 36 is slidably mounted on the guide rods 35 and is able to move for a predetermined distance along the guide rods 35. The front block 31c is connected to the bottom surface of the back portion of the supporting body 36 by a cylinder 44. The front portion of the supporting body 36 is formed by an upwardly projected body 36a.

Figure 4:
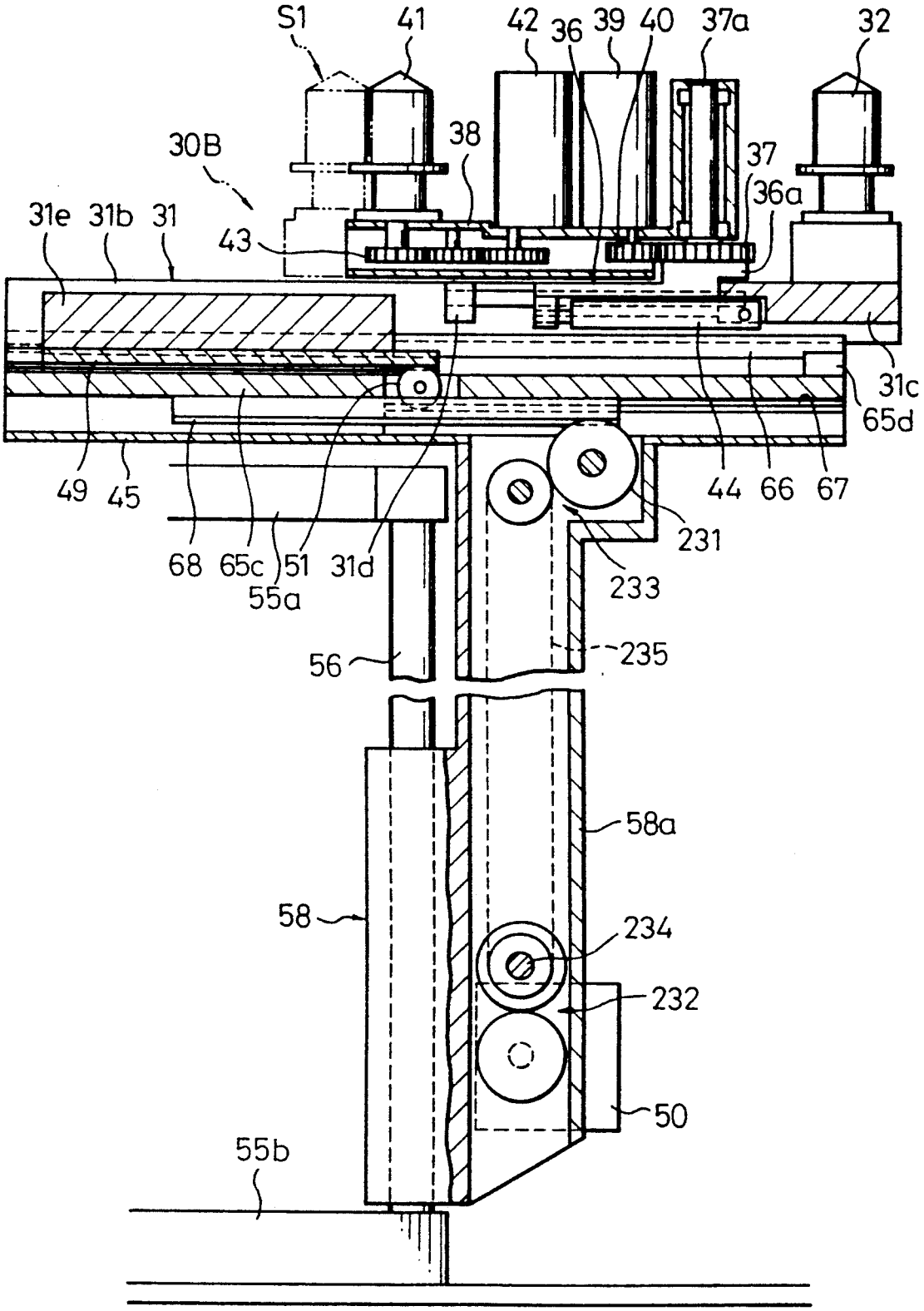
FIG. 4 is a partly cross-sectional view of the peg unit shown FIG. 3, taken along the row 1V—1V.

A stationary gear 37a provided with an upright shaft 37a is rigidly mounted on the projected body 36a, as shown in FIG. 4, and a bottom portion of a swing arm 38 is turnably mounted on the upright shaft 37a in such a manner that the swing arm 38 is able to swing about the upright shaft 37a. A swing motor 39 is mounted on the swing arm 38 and a gear 40 is arranged in such a manner that the gear 40 is driven by the motor 39 so that the swing motion of the swing arm 38 is actuated by meshing the gear 40 with the stationary gear 37. The back peg 41, which together with the front peg 32 forms a pair of pegs Pl is rotatably mounted on an upper surface of the front end portion of the swing arm 38 at the same level as that of the front peg 32, and the back peg 41 is rotated by a reversible motor 42 disposed on the upper surface of the swing arm 38 through a gear train as shown in FIG. 4. When the roving bobbin exchange operation is carried out, the rovings R2 taken from the full packaged roving bobbins FB mounted on the pegs 32, 41 are slackened, to create a suitable slackened condition, by rotating the pegs 32 and 41 for a predetermined number of rotations in the clockwise direction or the counter clockwise direction.

Figure 30:
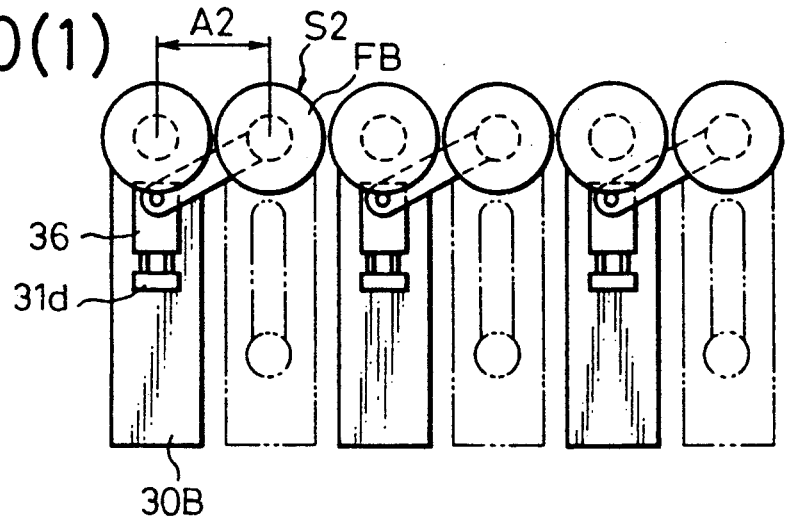
FIG. 30(1) to (3) explanatory views indicating the operation of changing the arrangement of three pairs of roving bobbins, wherein three bobbins are roving bobbins of the front row and the other three bobbins are roving bobbins of the back row, according to the operation by the apparatus shown in FIG. 1.
Figure 30:
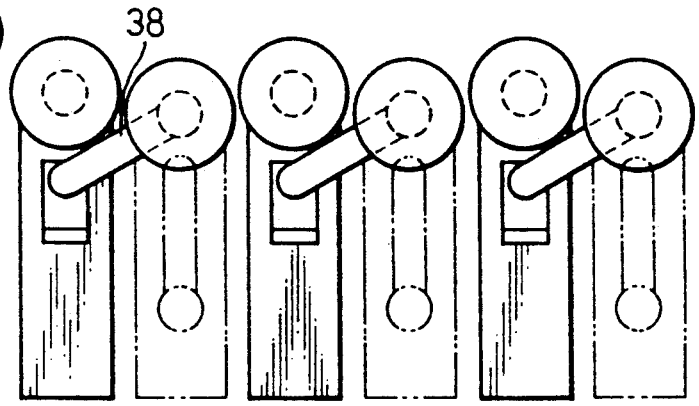
Figure 30:
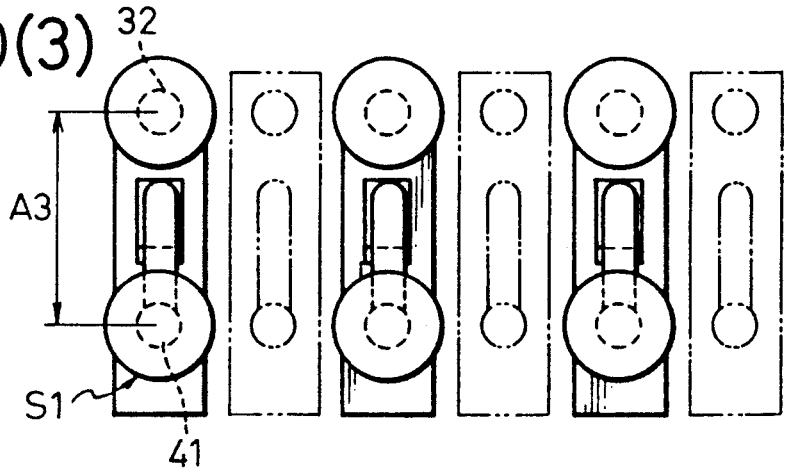
Figure 31A:
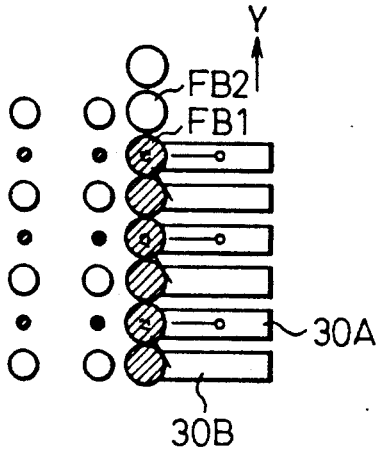
FIGS. 31(*a*) to (*d*) are explanatory views indicating the operation of changing the arrangement of three pairs of roving bobbins, wherein three bobbins are roving bobbins of the front row and three are roving bobbins of the back row, at one side of the spinning frame, according to the apparatus shown in FIG. 1.
Figure 31B:
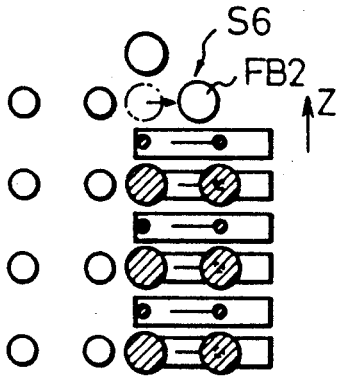
Figure 31C:
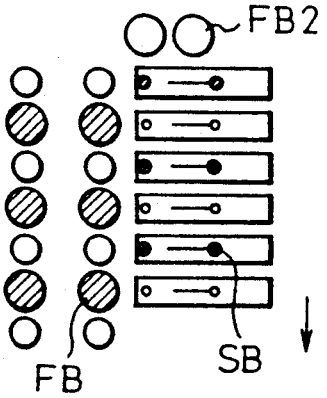
Figure 31D:
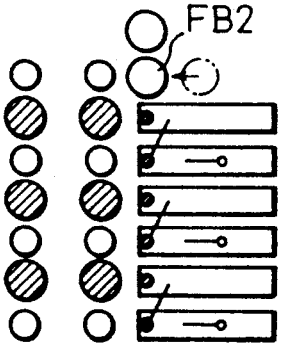

The distance between the axial center of the upright shaft 37a and the axial center of the back peg 41, which corresponds to the turning radiusof the displacing motion of the back peg 41 by the swing motion of the swing arm 38, and the displacing distance of the supporting body 36 toward the direction perpendicular to the lengthwise direction of the spinning frame 1 satisfy the condition that, when the supporting body 36 is positioned at a rear terminal point of the motion thereof, at which the supporting body 36 comes into contact with the intermediate block 31d and the back peg 41 is alignmened with the front peg 32, the back peg 41 is positioned at a standby position S1 (see FIG. 30(3)) at which the pitch between the front peg 32 and the back peg 41 coincides with a pitch A3, which is a pitch between a front bobbin hanger 7a and a back bobbin hanger 7b of each pair of front and back bobbin hangers of the creel portion 2 of the spinning frame. When the swing arm 38 is turned by a predetermined swing angle so that the supporting body 36 comes into contact with the front block 31c, the supporting body 36 reaches the front terminal point of the displacing motion thereof, and the back peg 41 is at a displaced position S2, as shown in FIG. 30(2), and at the pitch A2.

Moreover, as shown in FIG. 30(2), in particular the condition is satisfied that, when the supporting body 36 reduces the rear terminal point of its motion the back peg 41 is placed at the standby position S1 by turning the swing arm 38. Due to this particular construction of the pair of pegs 32 and 41 and the mechanism of displacing the back peg 41, the supporting body 36, even if the full packaged roving bobbin FB is mounted on the back peg 41 which diameter is almost identical to the pitch A2, this full packaged roving bobbin FB will not interfere with another full packaged roving bobbin FB mounted on the back peg 41 of the adjacent pair Pl of pegs 32 and 41.

Next, the mechanism and function of the device for displacing the peg unit 30B backward and frontward is explained in detail. In each peg unit 30B, a pair of guide rods 47 is rigidly disposed on the upper surface of the bracket 46 and arranged at respective positions inside the base 45, which is provided with a shaped cross section having an upward opening, and face each other.

Figure 7:
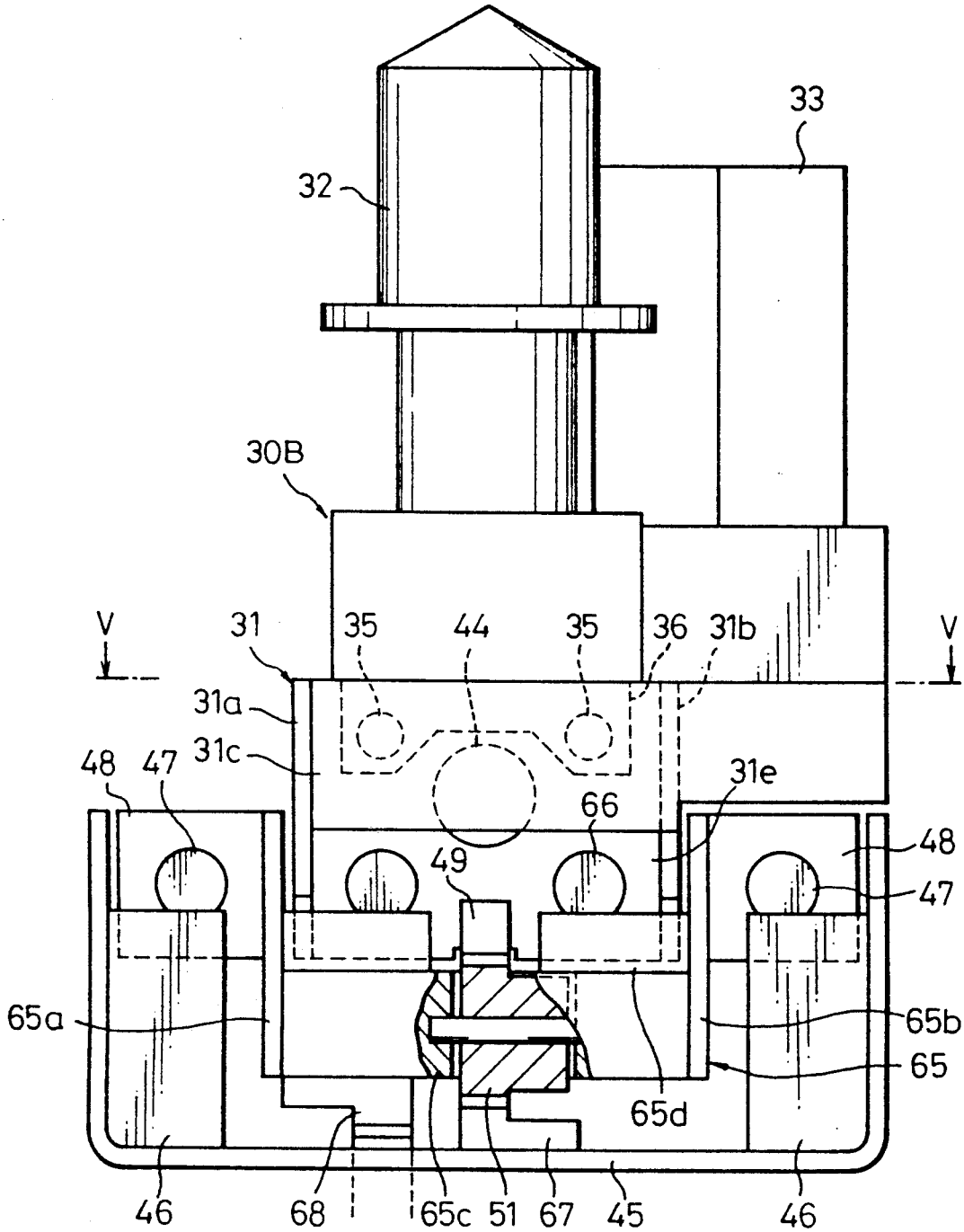
FIG. 7 is a front view of the peg unit shown in FIG. 4.
Figure 8:
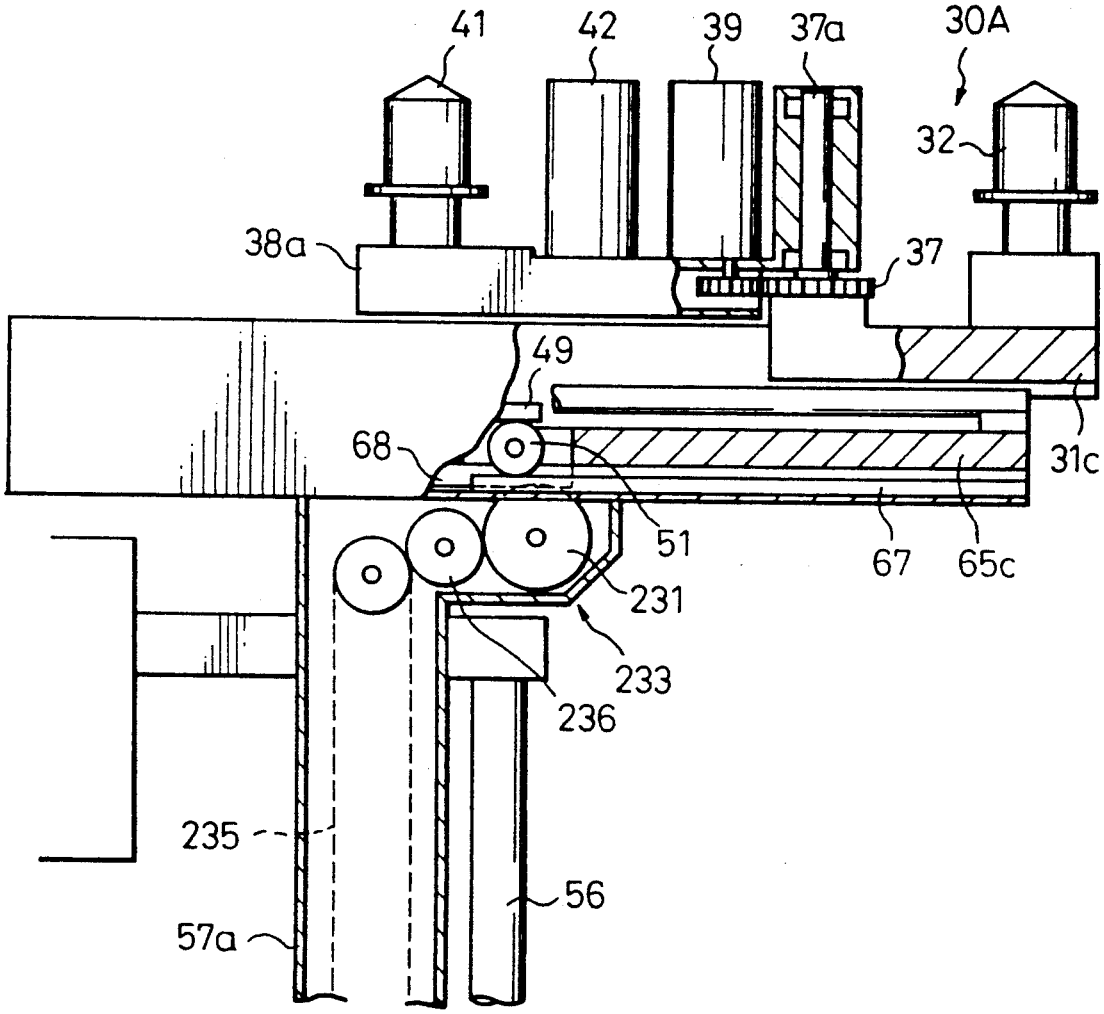
FIG. 8 is a partly cross-sectional view of a peg unit utilized for the almost exhausted roving bobbins.
Figure 9:
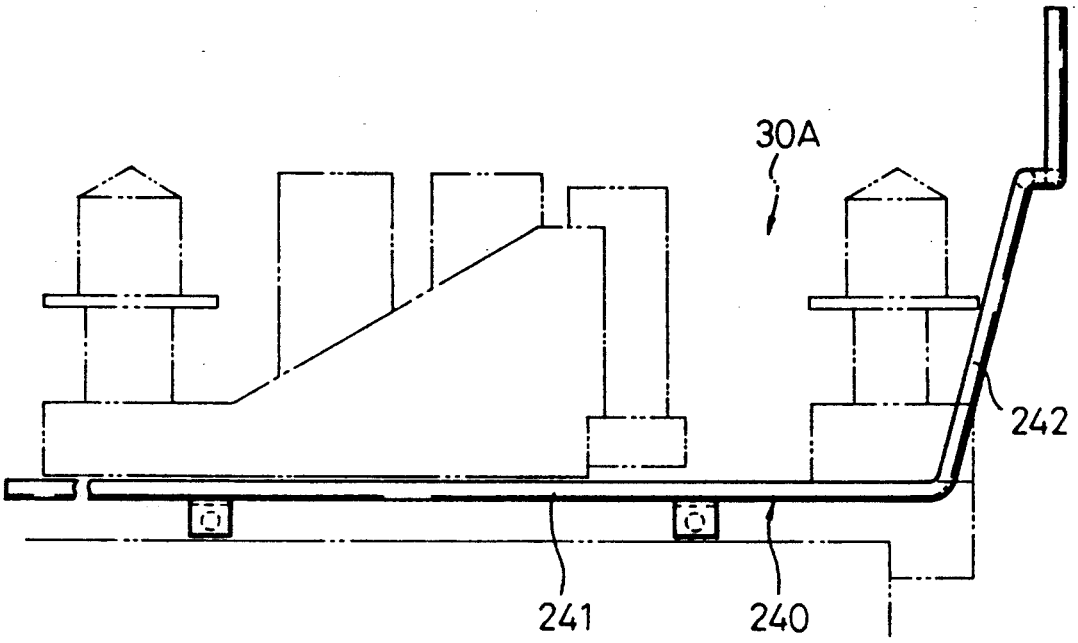
FIG. 9 shows a guide element for separating slivers, mounted on the roving bobbin exchange apparatus shown in FIG. 1.
Figure 10:
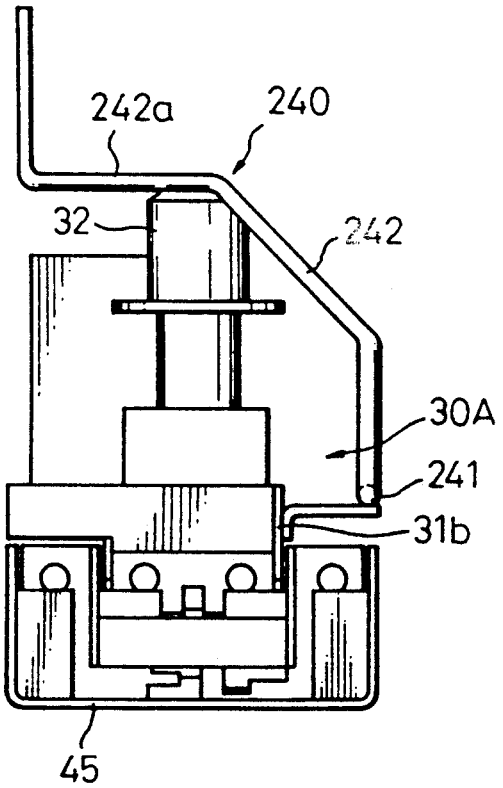
FIG. 10 is a front view of the guide element shown in FIG. 9.

As shown in FIGS. 5 and 7, a pair of guide members 48, which are rigidly secured to the back portion of a slider 65, are slidably mounted on the guide rods 47. Side plates 65a and 65b of the slider 65 are connected by a bottom plate 65c for the entire length thereof, and a pair of brackets 65d, which face the respective inside positions of both end portions of the slider 65, is provided with a corresponding guide rod 66 secured thereto and extending perpendicularly to the lengthwise direction of the spinning frame 1. A back block 31e of the slide body 31 is slidably mounted on the slide rods 66.

Figure 6:
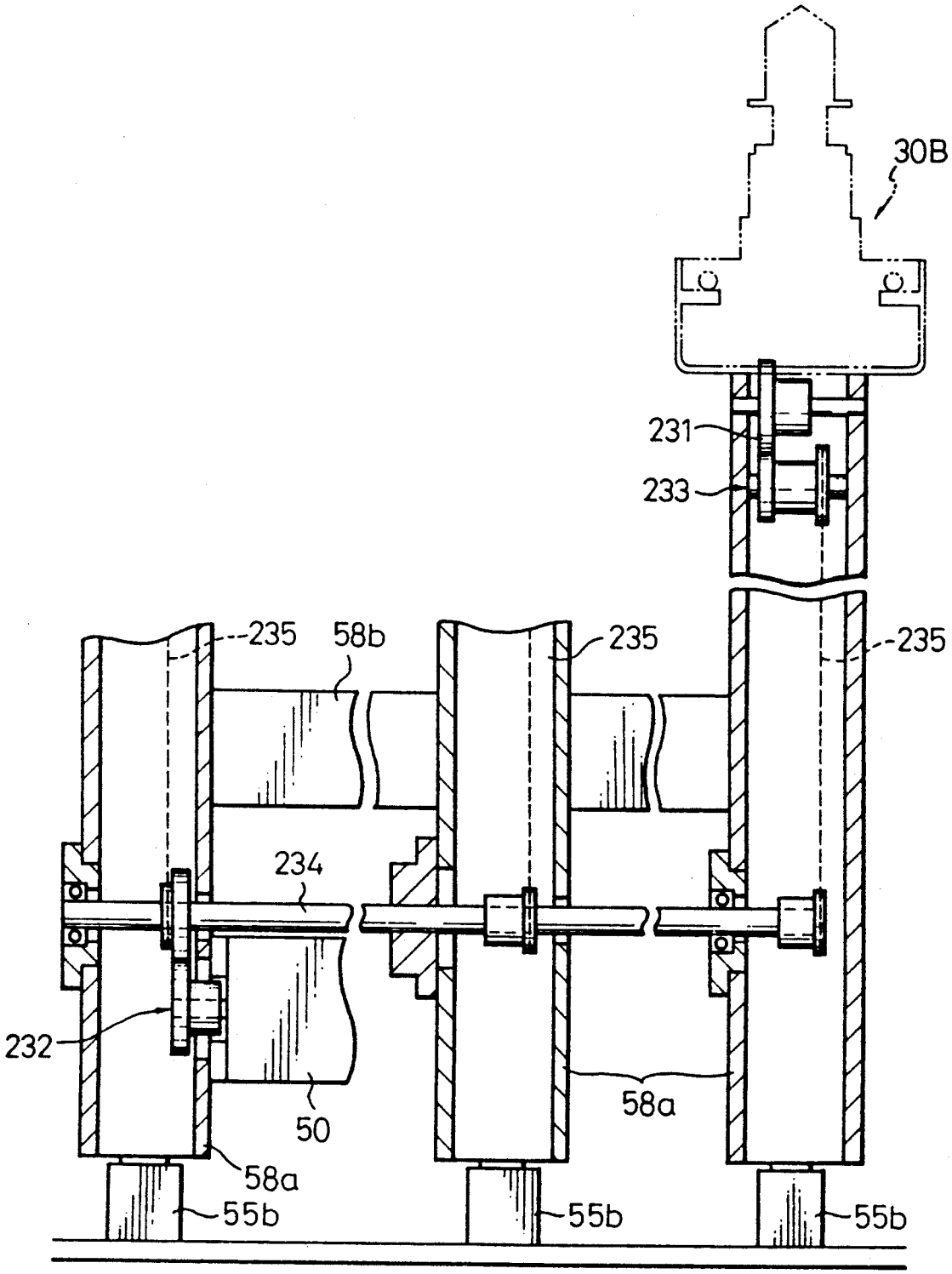
FIG. 6 is a partly omitted plan view of the peg unit shown in FIG. 3.

As shown in FIG. 4, the above-mentioned base 45 is provided with a first rack 67, which is secured to the base 45 at a position extended from a central position toward the front side thereof, so that the first rack 67 meshes with a pinion 51 rotatably supported by a bottom plate 65c of the slider 65. A second rack 49 is secured to a bottom surface of a back block 31e of a slide body 31 at a portion extended from a position of the pinion 51 thereof toward a back end of the slide body 31, so that the pinion 51 meshes with the second rack 49. A third rack 68 having a length almost identical to the first rack 67 is secured to the bottom plate 65c of the slider 65, in parallel to the first rack 67, at a position extended to cover the first and second racks 67 and 49. As shown in FIGS. 4 and 6, a drive gear 231, which meshes with the third rack 68, is rotatably supported at a connected portion 58a of three lifting members 58, which is explained hereinafter in detail. The drive gear 231 is driven by a drive motor 50 secured to a bottom end portion of one of the three lifting members 58, through gear trains 232 and 233, a drive shaft passing through the three lifting members 58, and a chain drive mechanism 235. Accordingly, when the gear 231 is driven from the relative condition of the above-mentioned machine elements shown in FIG. 4, in each one of three peg units 30B, the slider 65 is displaced towards the front side by the motion of the third rack 68, whereby the pinion 51 is driven by the first rack 67. According to the rotation of the pinion 51, the slide body 31 is displaced by twice the distance of the forward displacement of the slider 65 toward the front side. Therefore, the peg unit 30B can be displaced forward and backward between a position at which the back peg 41 is at a standby position S1 in the roving bobbin exchange apparatus 20 and a position at which the back pegs 32 and 41 are at respective positions below the corresponding bobbin hanger 7a, 7b of the creel portion 2 of the spinning frame 1.

The peg unit 30A utilized for almost exhausted roving bobbins has a rack member like the supporting body 36 mentioned above and a mechanism for displacing the same forward and backward, and a stationary gear 37 is secured to the front block 31c. Therefore, the radius of the turning motion of the swing arm 38a is larger than that of the peg unit 38B utilized for full packaged roving bobbins FB, created by the forward and rearward motion of the stationary gear 37, i.e., the shaft 37a, in the peg unit 30B. Accordingly, the back peg 41 can be moved to the standby position S1 and the displaced position S2 by only the horizontal swing motion of the swing arm 38a, and as a result, the almost exhausted roving bobbins SB can be moved from the roving bobbin arrangement represented by the peg unit Pl to the roving bobbin arrangement represented by the peg unit P2.

The swing arms 38, 38*a* of the peg units 30A, 30B constitute a peg displacement device which has a function of changing the peg row between the front-back pair Pl and the right-left pair P2. The mechanism for displacing the peg unit 30A in the front-back direction is almost identical to that of the peg unit 30B, except that the gear train 231, which drives the third rack 68, has an intermediate gear 236. A right side plate 31*b* of the slide 31 is provided with a sliver separation guide 240, which is secured thereto, and the sliver separation guide 240 has a bar 241 extended in the front-rear direction and a guide portion 242 having a curved portion extended from the front end of the bar 240 to a front-upper direction and crossing in front of an upper end of the front peg 32 and directed upward at a position above the left side plate of the base 45. The roving separation guide 240 functions to operate the roving piecing operation shown in FIG. 28 (*d*), i.e., the roving R2 positioned in front of the peg unit 30A is displaced to a side of the peg unit 30A when the peg unit 30A is displaced frontward, and consequently, any possible interference by the full packaged roving bobbin FB of the peg unit 30A with the roving R2 can be prevented. An identical result can be expected for the almost exhausted roving bobbin SB mounted on the peg unit 30A.

Figure 11:
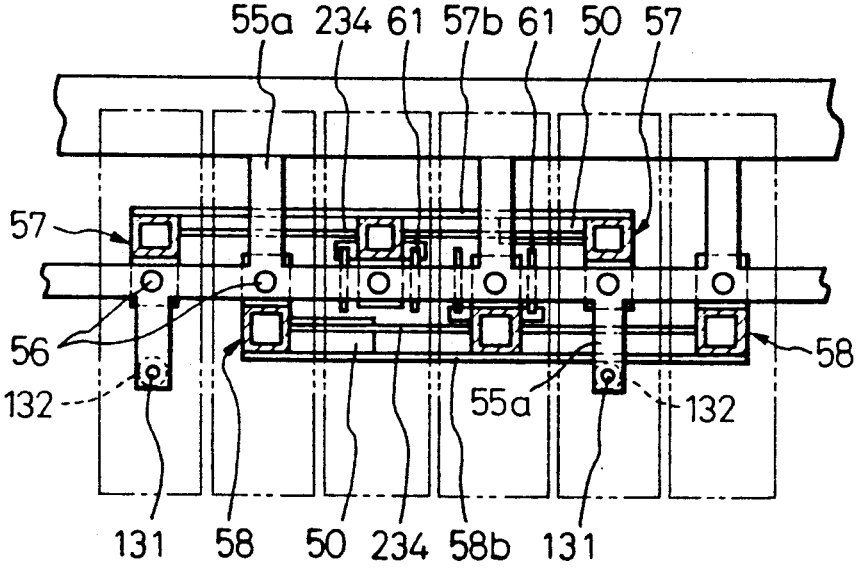
FIG. 11 is a side view of a lifting device of a peg unit utilized for the roving bobbin exchange apparatus shown in FIG. 1.
Figure 12:
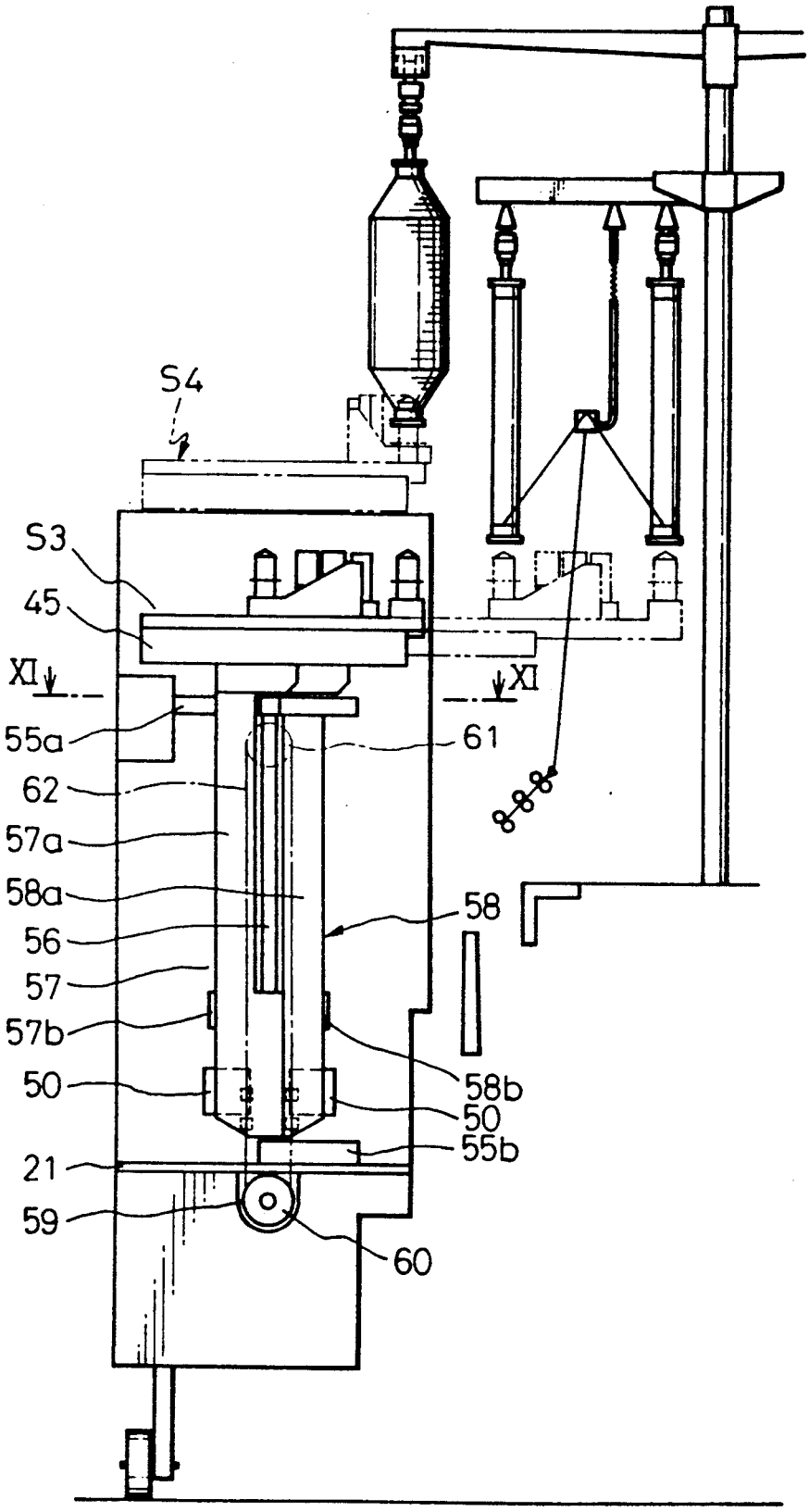
FIG. 12 is a cross-sectional view of the lifting device shown in FIG. 11, taken along the row XII—X11.
Figure 13:
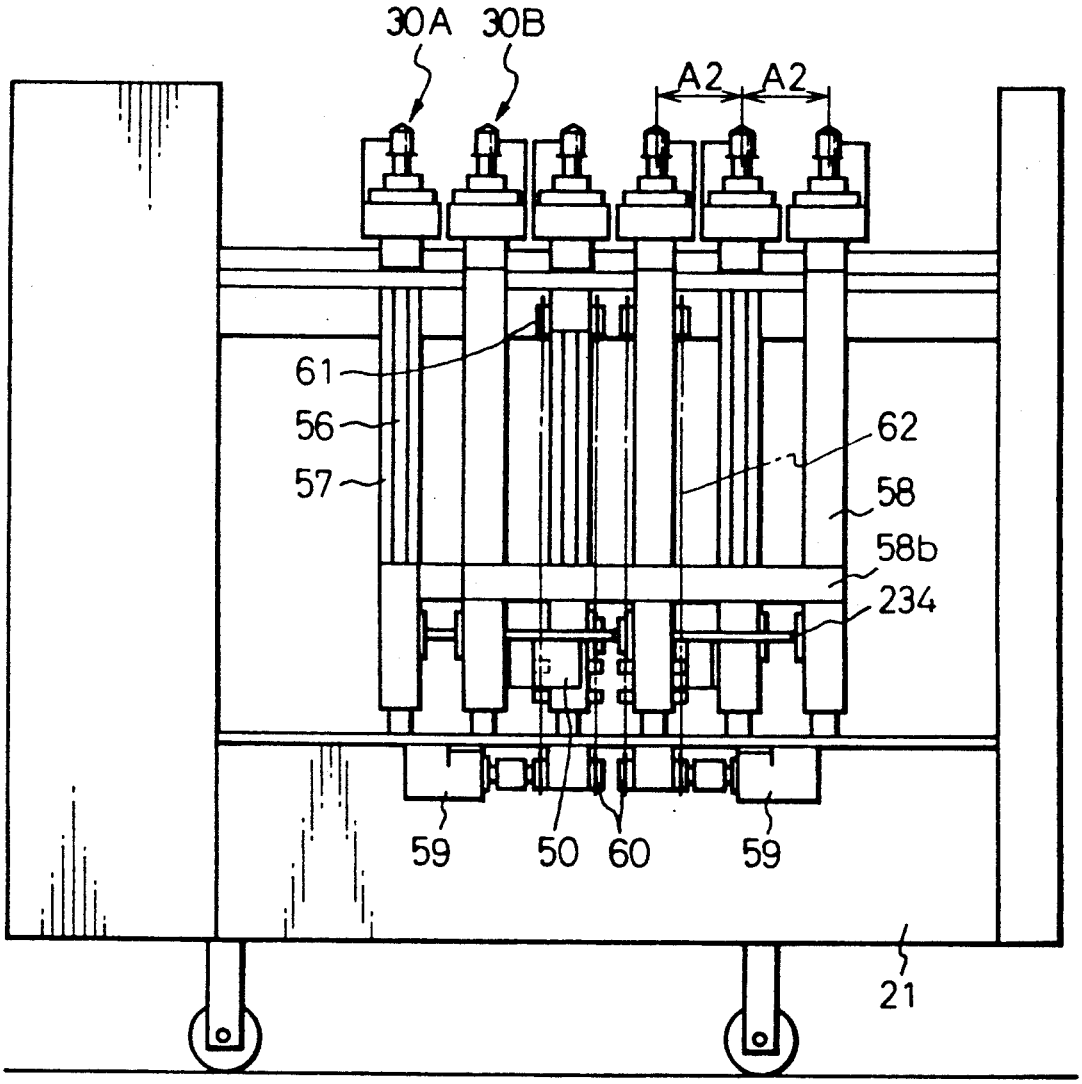
FIG. 13 is a front view of the lifting device shown in FIG. 11.

Next, the mechanism and function of the lifting device of the peg units 30A and 30B are explained in detail with reference to FIGS. 11 to 13. Six upright guide rods 56 are arranged between the upper bracket 55*a* and a lower bracket 55*b* on the main body 21 of the roving bobbin exchange apparatus 20. These six guide rods 56 are divided into two groups of three arranged alternately. A lifting member 57 utilized for the almost exhausted roving bobbin SB is mounted on each guide rod 56 of the first group of the guide rods 56, and a lifting member 58 utilized for the full packaged roving bobbin FB is mounted on each guide rod 56 of the second group of the guide rods 56, such that it can be lifted along the guide rod 56. The three lifting members 57 and the three lifting members 58 are connected by respective connecting plates 57*b* and 58*b*. The above-mentioned bases 45 are respectively connected to connecting portions 57*a* of the lifting member 57, 58*a* of the lifting member 58, which extend upward, respectively, such that the right-left pitch between the back pegs 32, 41 of the peg units 30A and 30B, which are positioned adjacently so that the back pegs 41 are at the standby position, coincides with the right-left pitch A2 between two adjacent bobbin hangers 7*a* or 7*b* of the front and back row of bobbin hangers 7 of the creel portion 2 of the spinning frame 1. A pair of lifting motors 59 are mounted on the main body 21 of the apparatus 20 at the bottom thereof, and a pair of sprocket wheels 60 are rigidly mounted on a motor shaft extended inward from each lifting motor 59. Further, two pairs of sprocket wheels 61 are rotatably mounted on an upper bracket 55*a* of the main body 21 of the apparatus 20 at positions corresponding to the sprocket wheels 60, and an endless chain 62 is mounted on one of sprocket wheels 60 of each pair of sprocket wheels 60 and corresponding to one of the sprocket wheels 61 of the corresponding lifting motor 59, as shown in FIGS. 12 and 13. Each of the lifting members 57 and 58 is connected to an intermediate portion of the corresponding endless chain 62 so that the peg units 30A, 30B can be displaced between the standby position thereof (S3 in FIG. 12) and the uppermost position (S4 in FIG. 12) where roving bobbins are mounted on or dismounted from the corresponding bobbin hanger 12 of a bobbin carriage 13 supported by the supplemental rail 11 (FIG. 12) by the motion of the endless chains 62. As mentioned above, in this embodiment, the device for handling almost exhausted roving bobbins SB is formed by the peg unit 30A, the device for displacing the peg units 30A in the front-back direction, and the device for lifting the peg unit 30A, and the device for handling full packaged roving bobbins FB is formed by the peg units 30B, the device for displacing the peg units 30B in the front-back direction, and the device for lifting the peg units 30B.

Figure 14:
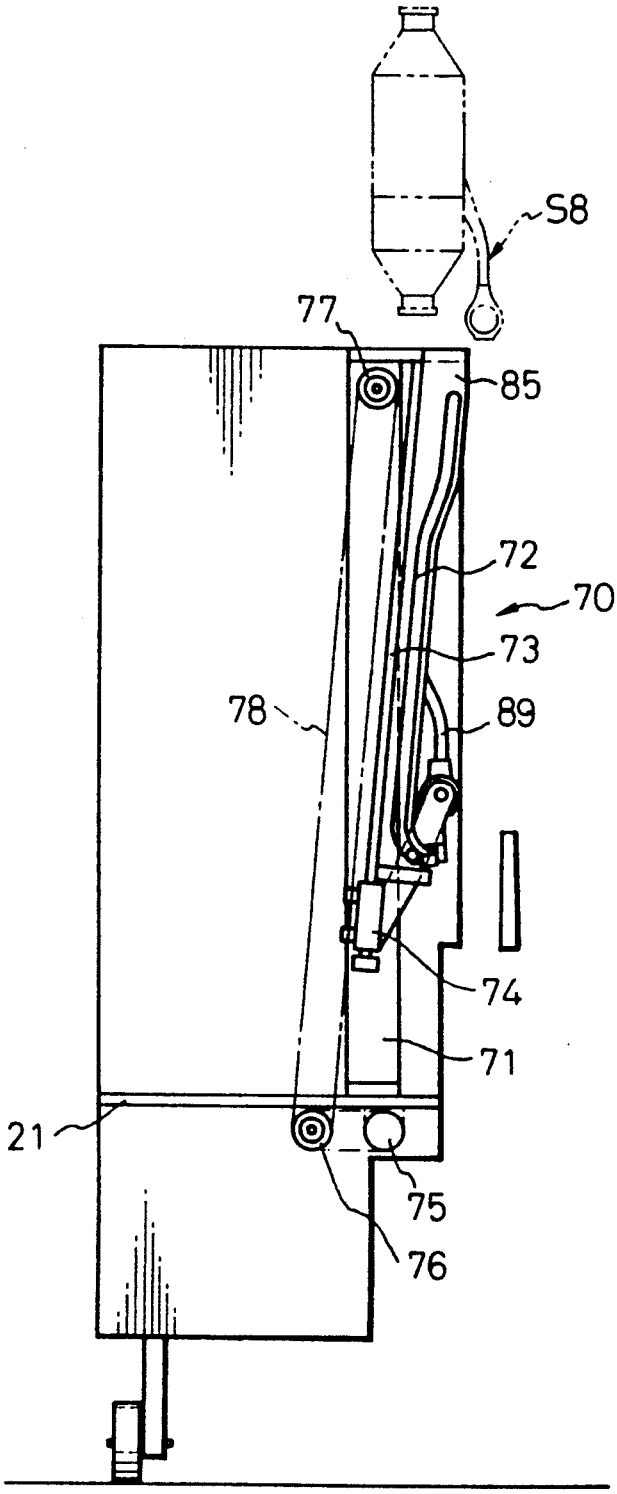
FIG. 14 is a side view of a device for taking an end of a roving, utilized for the roving bobbin exchange apparatus shown in FIG. 1.
Figure 15:
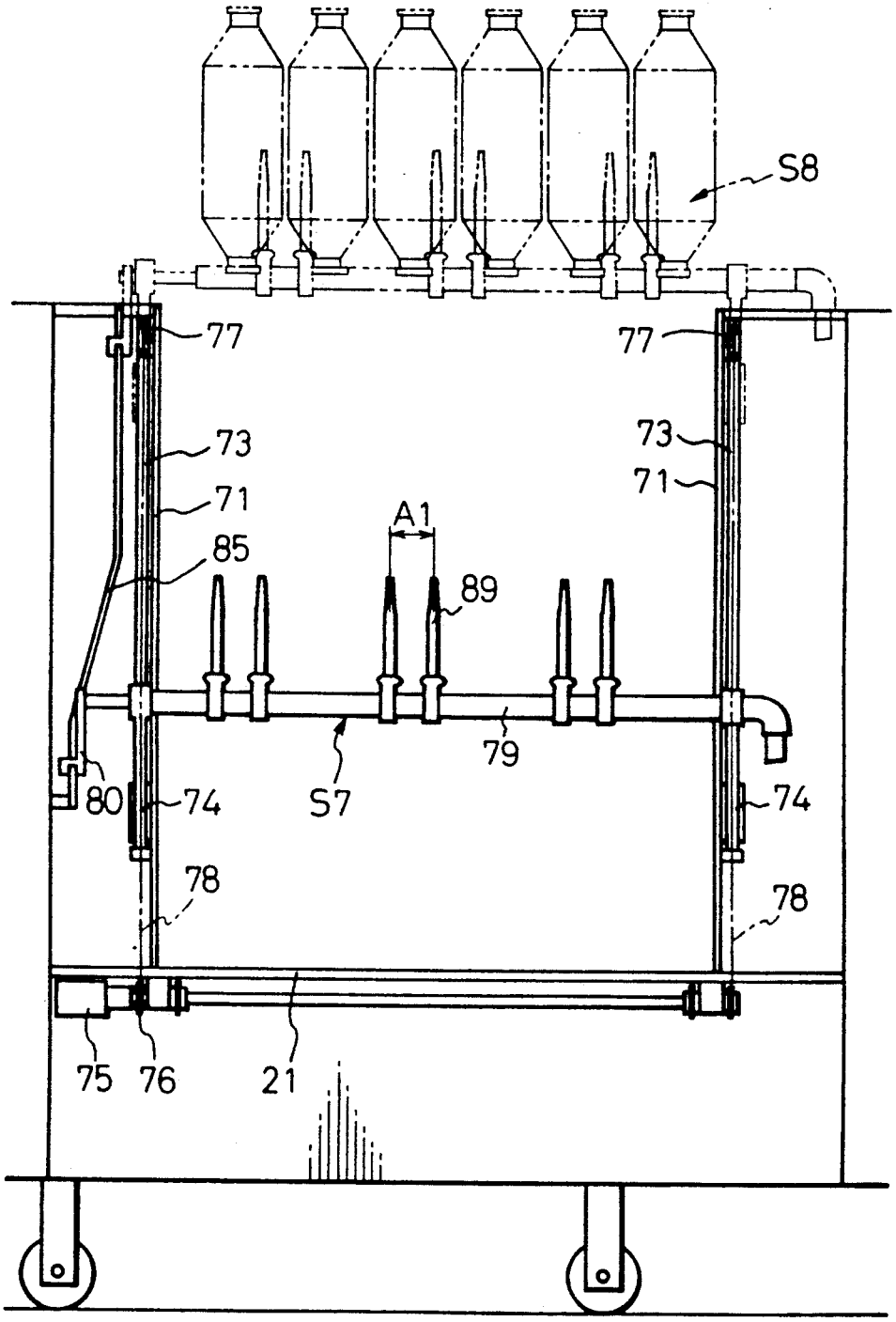
FIG. 15 is a front view of the roving end taking device shown in FIG. 14.
Figure 16:
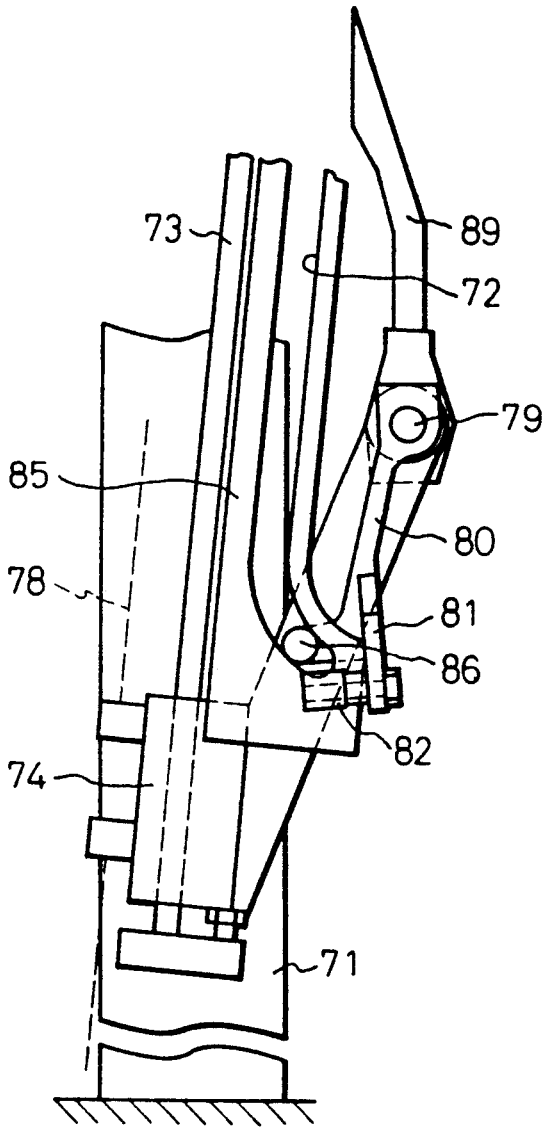
FIG. 16 is an enlarged view of a cam portion of a displacing plate utilized for the apparatus shown in FIG. 1.
Figure 17:
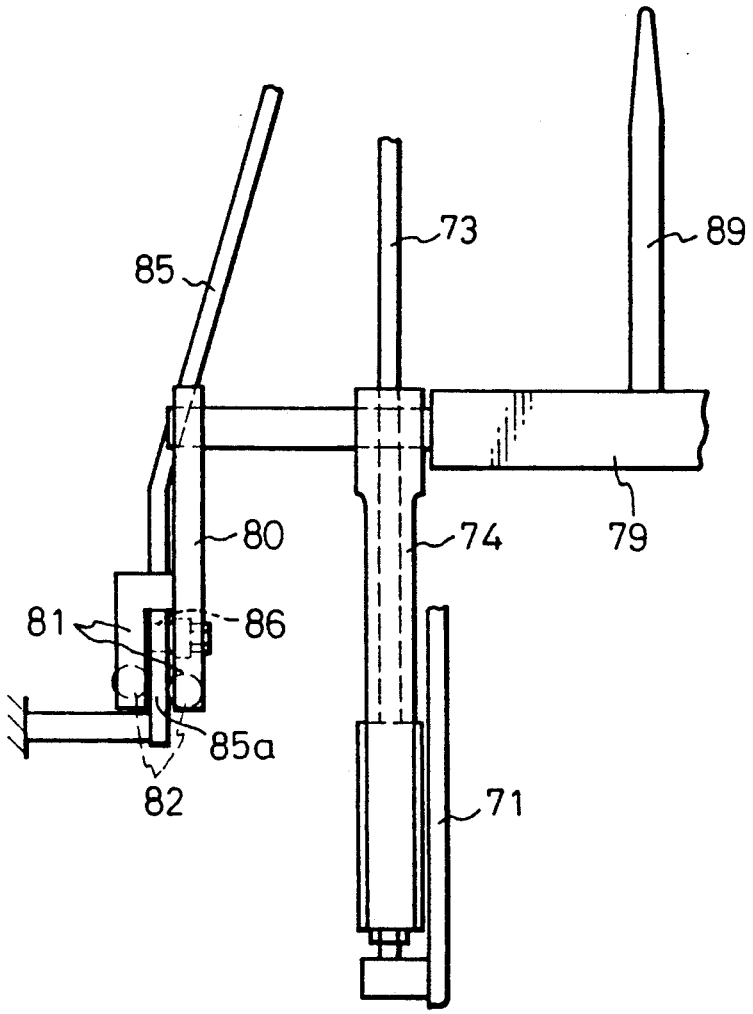
FIG. 17 is a front view of the displacing plate shown in FIG. 16.

Next, the device for taking free ends of rovings from the respective roving bobbins is hereinafter explained in detail with reference to FIGS. 14 and 15. As shown in these drawings, a pair of side plates 71 are secured to the bottom surface of the main body 21 of the apparatus, and these side plates 71 are extended upward at the corresponding side of the body 21, respectively. Each of the side plates 71 is provided with a guide rod 73 extended to an upper position of the side plate 73 while inclined thereto, and a slide block 74 is slidably mounted on each of the guide rods 73. A sprocket wheel 76, which is driven by a drive motor 75 rigidly disposed on the bottom surface of the main body 21, is rotatably mounted on each side of the main body 21, and another sprocket 77 is rotatably mounted on each side of the main body at respective upper positions thereof. An endless chain 78 is mounted on the sprocket wheels 76 and 77 at both sides of the main body 21, and the guide block 74 is connected to the corresponding endless chain 78 at both sides of the main body 21. A pipe 79 is rotatably supported by an upper end of the slide blocks 74 such that the pipe 79 also can slide along the axial direction thereof; one end portion of the pipe 79 being connected to a suction air source (not shown), and the other end portion thereof being rigidly connected to a lever 80, as shown at the left of FIG. 15. As shown in FIG. 17, a free end of the lever 80 is provided with a forked portion having two separate elementary portions 81 and a cam follower 82 is rotatably supported on each of the elementary portions 82. These cam followers 82 sandwich a free bottom end 85*a* of a plate cam 85 secured to a left one of the side plates 71 (see FIGS. 15 and 17) disposed at the main body 21 of the apparatus 20. The plate cam 85 is designed such that, when the slide blocks 74 are synchronously displaced upward, the pipe 79 is displaced along the axial direction thereof, and takes a position as represented by a chain-row at the uppermost position of the slide blocks 74 in FIG. 15. Namely, the pipe 79 is displaced along the axis thereof by the lifting motion of the slide block 74 and the pitch of the slide motion of the pipe 79 is identical to the pitch Al between the trumpets of two adjacent draft parts of the spinning frame 1. As shown in FIGS. 15 and 16, three pairs of suction nozzles 89 are mounted such that each suction nozzle 89 is connected to the pipe 79, and the pitch between two nozzles 89 of each pair is identical to the pitch Al, while the pitch between two adjacent pairs of the suction nozzles 89 is four times the pitch Al. The plate cam 85 is provided with a cam groove 72, as shown in FIG. 16, and another cam follower 86 is disposed on the lever 80 perpendicular to the axis of the cam followers 82. Due to the design of the cam groove 72 in relation to the lever 80 and cam follower 86, each suction nozzle 89 can be displaced along a moving trace which prevents any possible interference with the corresponding sliver piecing head 100 during a displacement of the slide blocks 74. Therefore, each of the suction nozzles 89 can be displaced upward and downward while being displaced in the lengthwise direction of the spinning frame 1 between the corresponding standby position S7 and the corresponding position for catching a free end of a roving from a full packaged roving bobbin FB.

Figure 2:
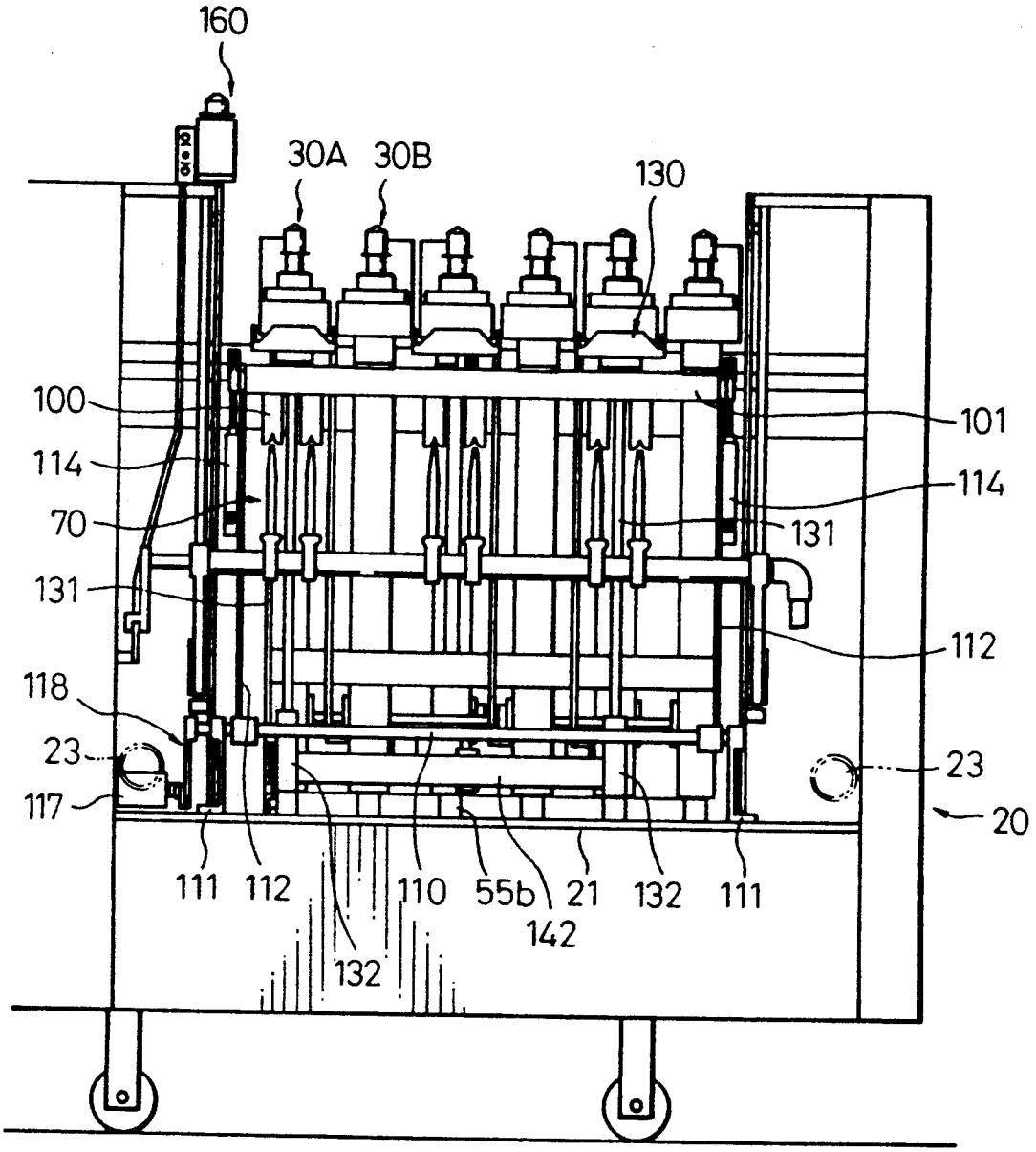
FIG. 2 is a front view of the roving bobbin exchange apparatus shown in FIG. 1.
Figure 3:
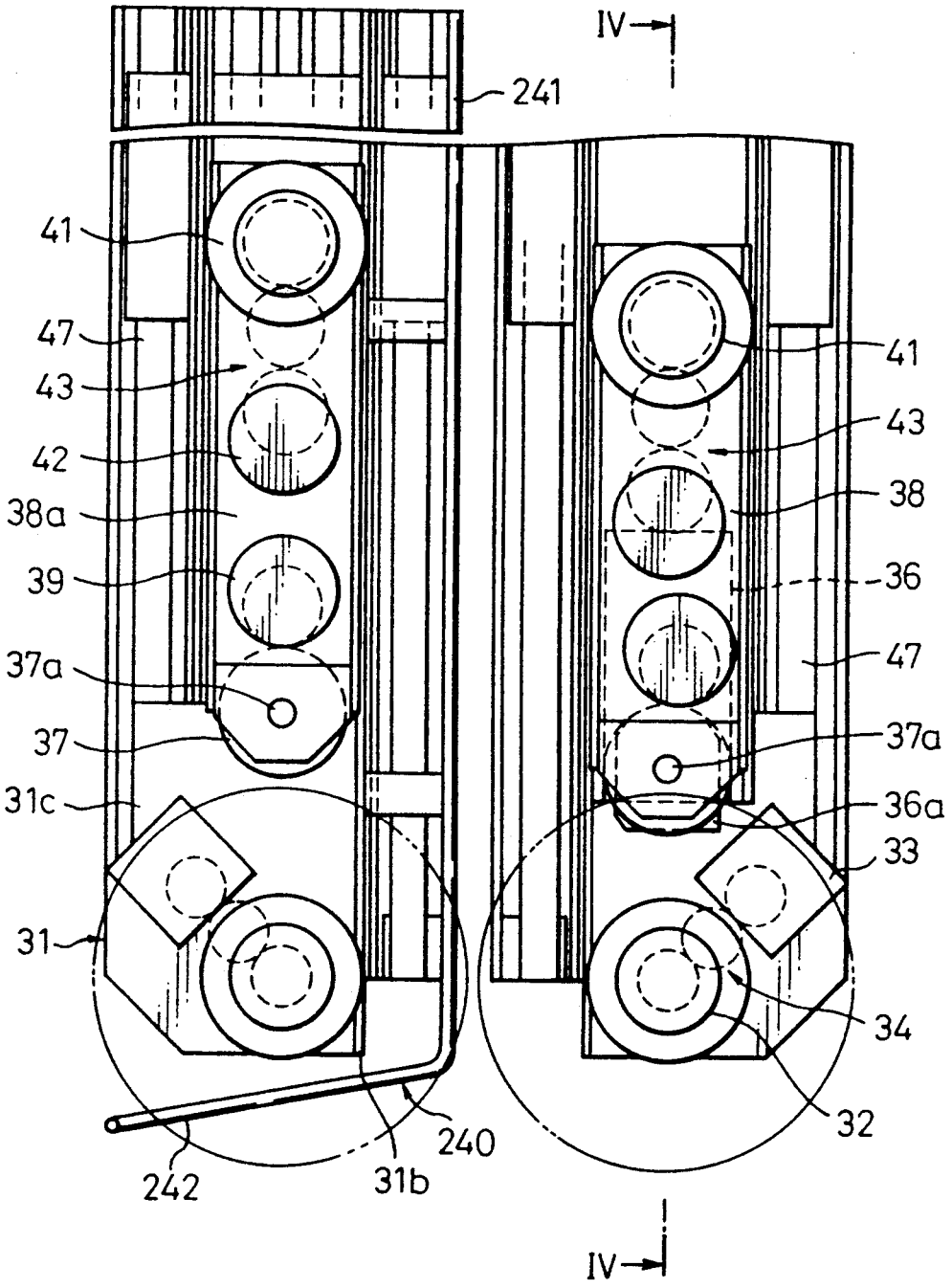
FIG. 3 is a plan view of a peg unit utilized in the apparatus shown in FIG. 1.
Figure 18:
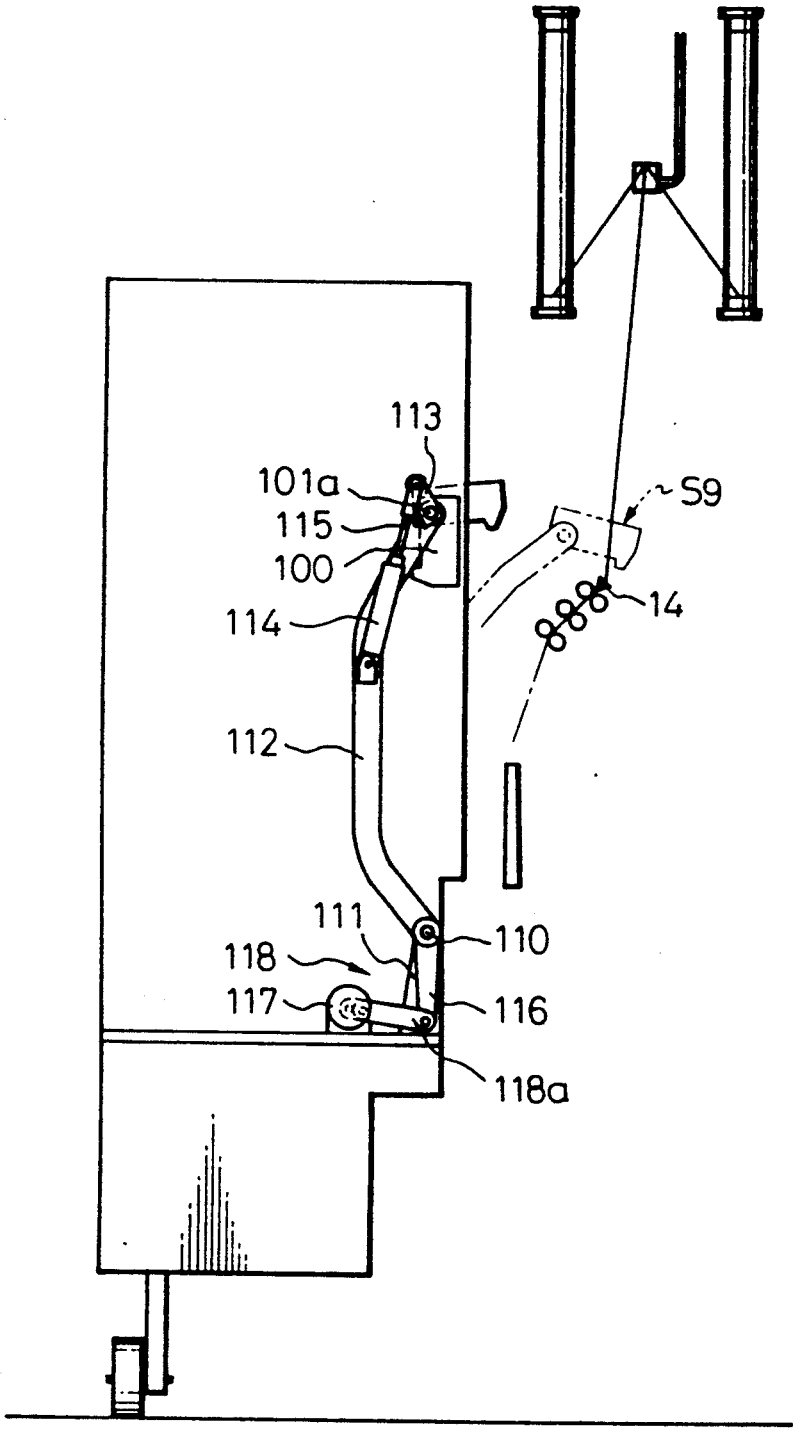
FIG. 18 is a side view of a device for displacing the roving piecing head utilized for the apparatus shown in FIG. 1.
Figure 19:
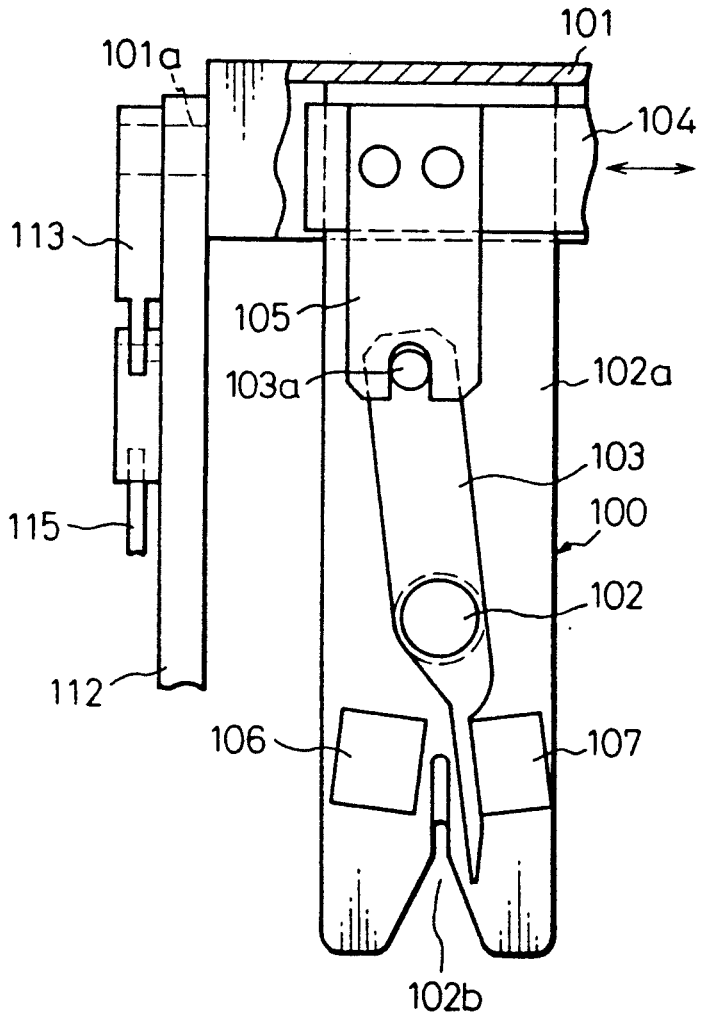
FIG. 19 is an enlarged view of the roving piecing head shown in FIG. 18.

Next, the mechanism and function of the roving piecing head 100, and the mechanism for actuating the roving piecing head 100, are hereinafter explained in detail with reference to FIGS. 2, 18, and 19. A horizontal shaft 110 is rotatably mounted on a pair of upright brackets 111 disposed at a front lower portion of the main body 21 of the apparatus 20, and a pair of arms 112 are secured at the ends of the shaft 110 (FIG. 2). A shaft portion 101*a* formed at one end of a supporting bar 101 of the roving piecing head 100 is provided with an arm 112.

The shaft 101*a* is projected from the arm 112, and a lever 113 is secured to this projected portion of the shaft 101*a*. The lever 113 is linked to a piston rod 115 of the swing cylinder 114 so that the roving piecing head can be swung between a horizontal position and a vertical position by the swing motion of the swing cylinder 114. One end of the shaft 110 is linked to an end of a lever 116, and the other end of the lever 116 is linked to a link lever 118*a* of a crank mechanism 118, which is driven by a motor 117. According to the motion of the crank mechanism 118, the arm 112 is provided with a swing motion between a standby position thereof and a terminal point of the forward motion thereof where the roving piecing head 100 is at a roving piecing position S9 while in a horizontal condition.

In the first embodiment of the present invention, the roving piecing head utilized in the apparatus disclosed in Japanese Unexamined Patent Publication No. 62-53425 is utilized. As shown in FIG. 2, the supporting bar 101 of each roving piecing head 100 is secured to a main body 102*a* of the head 100 at a position facing the suction nozzle 89, a roving holding lever 103 is mounted on each head body 102*a* such that it is swingable about a supporting shaft 102, an actuation lever 105 is rigidly mounted on a bar 104 which can be traversed to the right and left by a cylinder (not shown). The roving holding lever 103 is provided with a pin 103*a* projected toward the actuation lever 105 at a position facing the lever 105, and the lever 105 is provided with a recess for receiving the pin 103*a* whereby the roving holding lever 103 is forced to swing about the shaft 102 by the traverse motion of the actuation lever 105. The above-mentioned mechanism is designed to create a motion of the roving holding lever 103 such that the free end of the lever 103 can be positioned for holding a roving R2 of a full packaged roving bobbin FB while the free end thereof comes into contact with a stopper block 106 secured to the roving piecing head 100, can be positioned holding a roving R1 of an almost exhausted roving bobbin SB while the free end thereof comes into contact with a stopper block 107 secured to the roving piecing head 100, and can be positioned at an intermediate point where the free end thereof does not come into contact with the stopper blocks 106 and 107.

The construction and function of the roving hanging device 130 are hereinafter explained in detail with reference to FIGS. 11, 12, 20, 21, 22 and 23. As shown in FIGS. 11 and 12, a pair of upright guide rods 131 are disposed on the main body 21 of the apparatus 20 at the respective positions in front of the guide rods 56, which are positioned at both sides of the row of five guide blocks 56, in a space between the upper and lower brackets 55*a*, 55*b* (see FIG. 12). A pair of lifting blocks 132 are slidably mounted on the corresponding lifting blocks 132, respectively, and the lifting blocks 132 are connected by a connecting member 142. A horizontal swing shaft 133 is rotatably supported by the lifting blocks 132 at an space therebetween. The bottom ends of three roving hang bars 134 are secured to the swing shaft 133, an end of a lever 143 is rigidly connected to an end of the swing shaft 133, and a cam follower 143*a* is mounted on a shaft secured to the other end of the lever 143. The cam follower 143 is designed such that it is guided by a cam surface 144*a* of a plate cam 144 disposed in a space between the main body 21 of the apparatus 20 and the bracket 55*a*. The connecting member 142 is connected to an endless chain 141 mounted on a sprocket wheel 138 rotatably mounted on the upper bracket 55*a*, and a sprocket wheel coaxially and rigidly mounted on a motor shaft of a lifting motor 139, which is secured to a bottom surface of the main body 21 of the apparatus 20. The profile of the cam surface 144*a* is such that the free end of the roving guide member 145 of the roving hang lever 134 is moved to a position below the front creel by a swing motion thereof as shown in FIG. 28(*c*), then moved to a roving hanging position above the roving guide 9 as shown in FIG. 29(*b*), and thereafter, returned to the standby position thereof as shown in FIG. 29(*c*).

Figure 22:
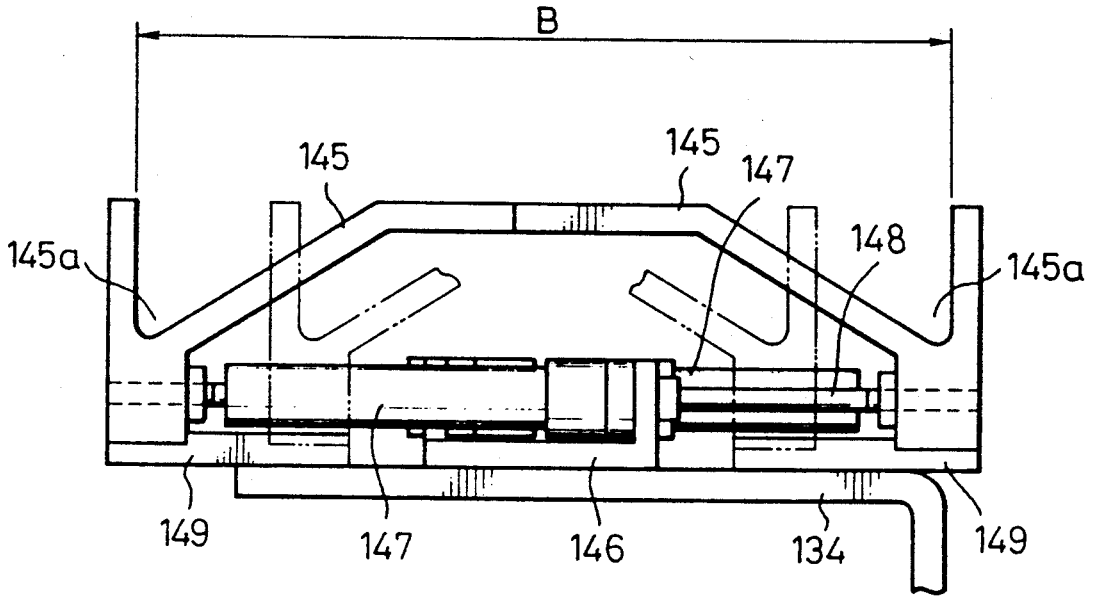
FIG. 22 is an enlarged drawing of a roving guide element utilized for the apparatus shown in FIG. 1.
Figure 23:
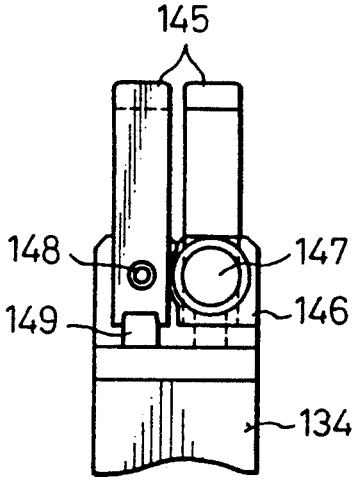
FIG. 23 is a side view of the roving guide elements shown in FIG. 22.

As shown in FIGS. 22 and 23, a pair of guide members 145 are formed at the free end of the roving hang lever 145. Namely, a pair of air cylinders 147 are arranged at a bracket 146 secured to the upper surface of the free end of the roving hang lever 134 such that the working directions of these air cylinders 147 are reversed, and a forked-shaped roving guide member 145 having a guide recess 145*a* is secured to the free end of a piston rod 148 of each air cylinder 147. The bottom of the roving guide member 145 is provided with a recessed surface, which is mounted on a horn-shaped guide bar 149 secured to the upper surface of the roving hang bar 134 so that each roving guide member 145 is traversed between a position represented by a solid row and a position represented by a chain row as shown in FIG. 22. The air cylinder utilized in the first embodiment of the invention is a conventional air cylinder whereby a spring is disposed in the cylinder so that a piston rod is projected outward by the action of the spring when the air cylinder 147 is not actuated. This condition is represented by a solid row in FIG. 22. In such a normal condition, the distance between the roving guide members 145 in the right-left directions is identical to the space A2 between two adjacent full packaged roving bobbins FB, and the recesses 145*a* of the roving guide members 145 face the respective openings 8 of the corresponding roving guides 9 having a C shape, respectively.

Figure 26:
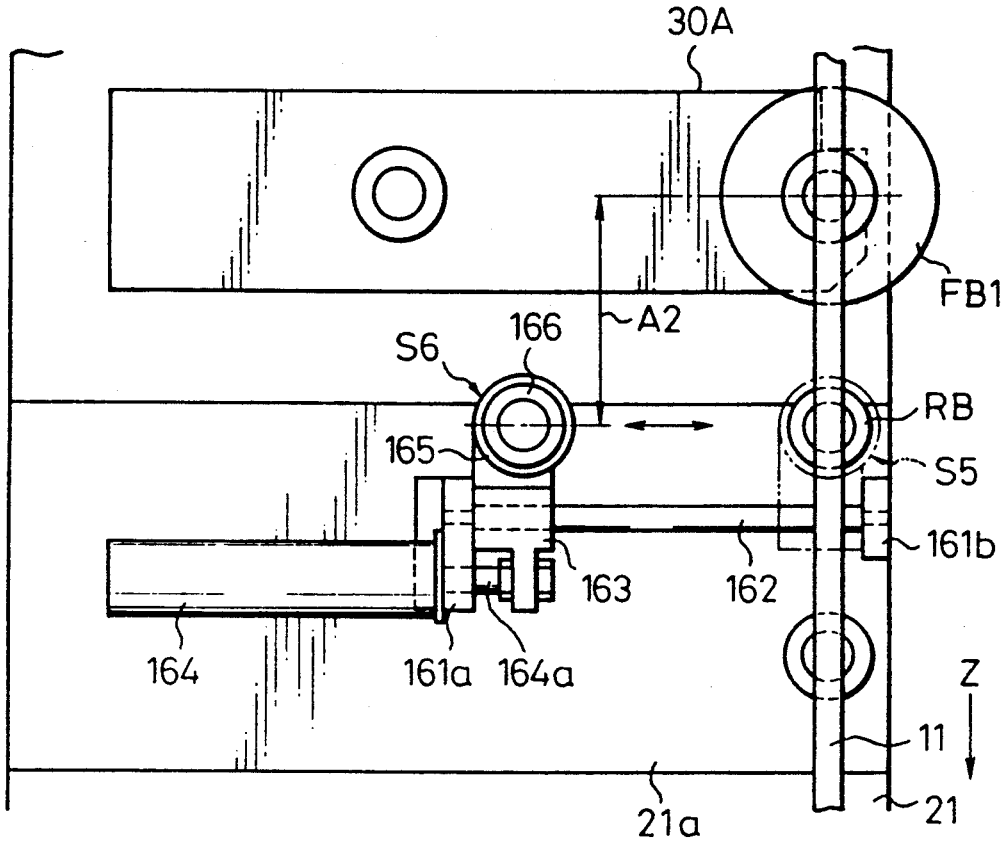
FIG. 26 is a plan view of a roving stocking element utilized for the apparatus shown in FIG. 1.
Figure 27:
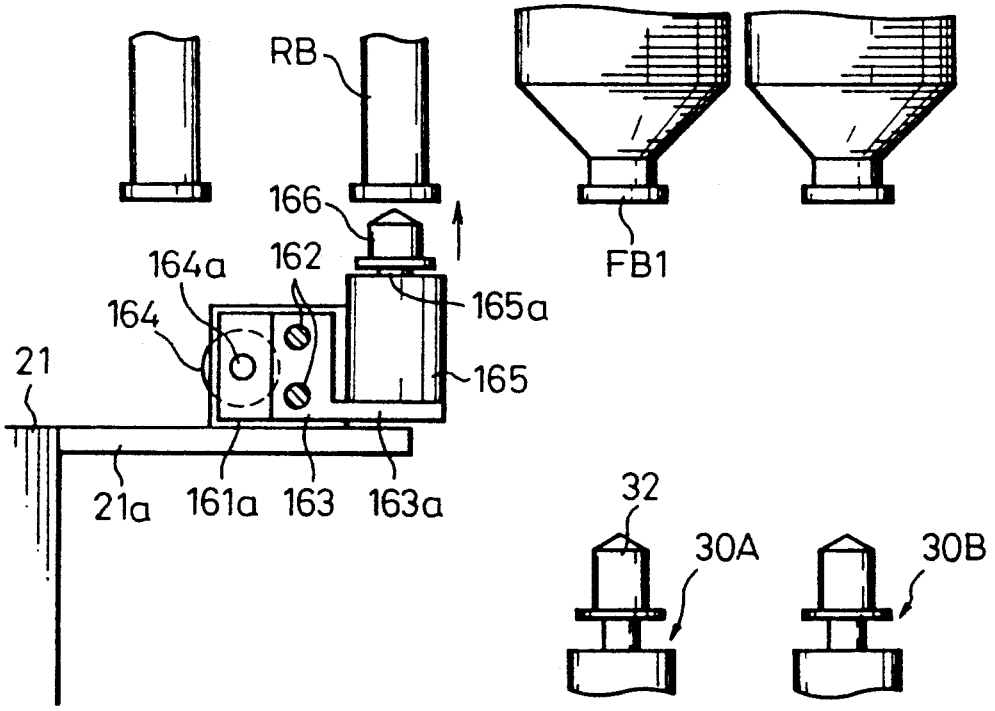
FIG. 27 is a front view of the roving stocking element shown in FIG. 26.
Figure 28A:
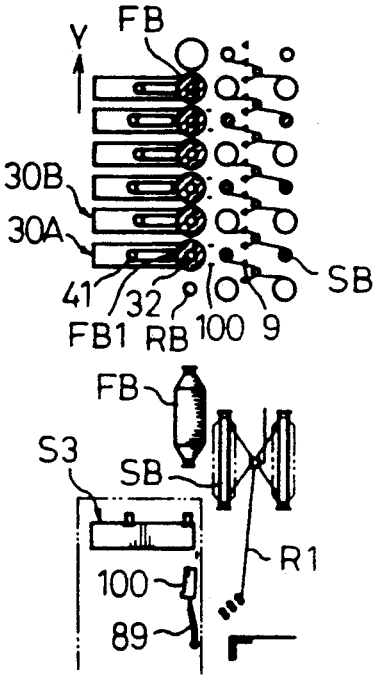
FIGS. 28(*a*) to (f) and 29(*a*) to (*f*) are explanatory views indicating the roving bobbin exchange operation utilizing the apparatus shown in FIG. 1.
Figure 28B:
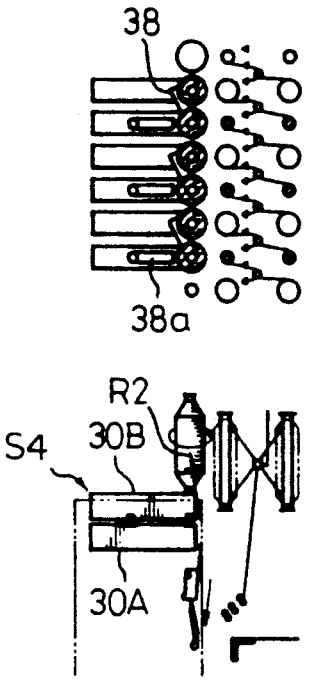
Figure 28C:
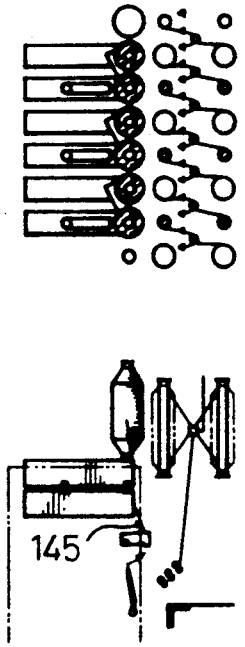
Figure 28D:
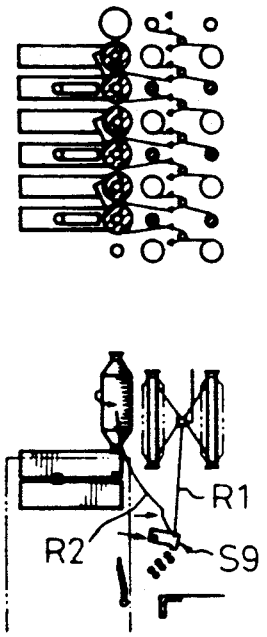
Figure 28E:
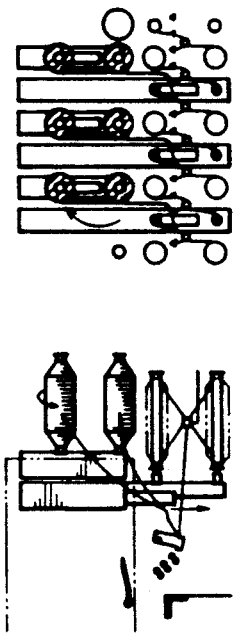
Figure 28F:
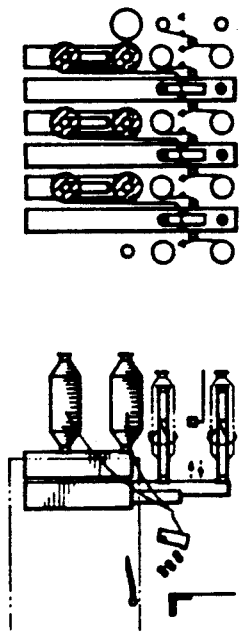
Figure 29A:
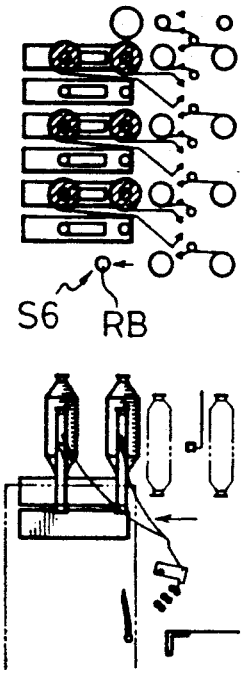
Figure 29B:
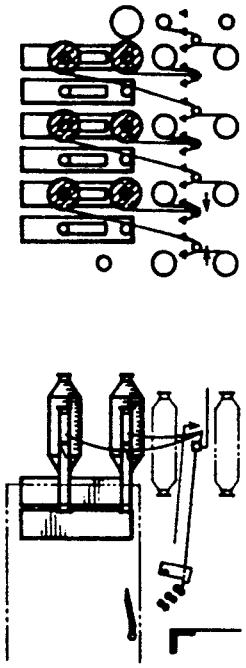
Figure 29C:
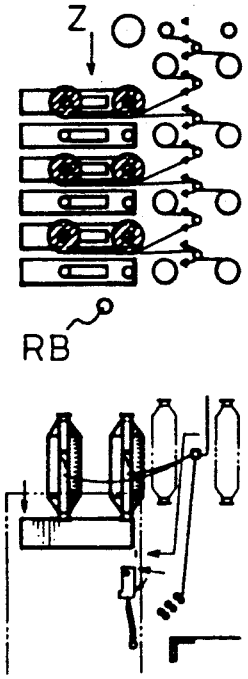
Figure 29D:
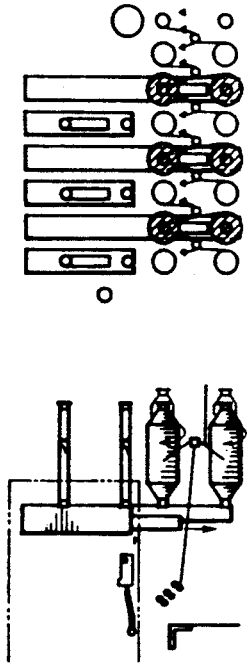
Figure 29E:
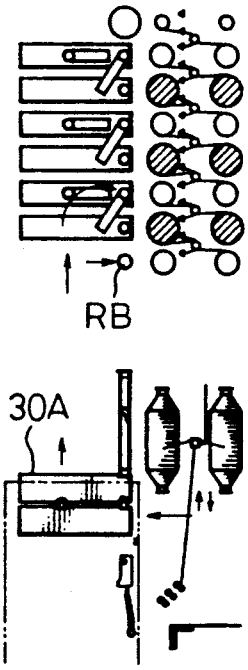
Figure 29F:
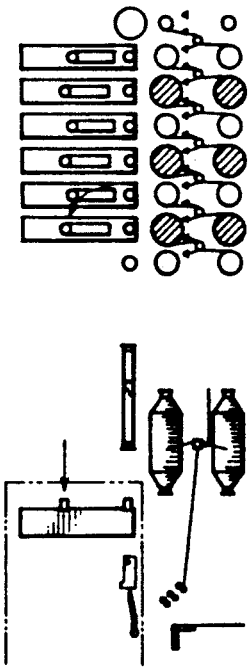

Next, the mechanism and function of the roving bobbin reserve device 160 for temporarily reserving roving bobbins taken from the bobbin hangers 12 of the supplemental rail 11 at reserving position separated from positions below the rail 11 is explained in detail with reference to FIG. 2. The device 160 is mounted on the main body 21 at the left of the peg unit 30A which is at the left most side of the row of peg units 30A and 30B in FIG. 2. As shown in FIGS. 26 and 27, a pair of brackets 161*a* and 161*b* are secured on an extended portion 21*a* of the main body 21, and the brackets 161*a* and 161*b* are connected by a pair of guide rods 162 arranged in parallel at upper and lower relative positions, and a slide base 163 is slidably mounted on the guide rods 162 so that the slide base 163 can slide forward and backward. The slide base 163 is provided with a supporting plate 163*a* secured thereto at the side of the peg unit 30A and connected to a piston rod 164*a* of a cylinder 164, which is disposed on the main body along the guide rod 162. As shown in FIG. 27, a cylinder 165 is mounted on the supporting plate 163*a* such that a piston rod 165*a* is directed upwards, and a peg 166 is disposed at an upper end of the piston rod 165*a* for mounting a roving bobbin thereon. The peg 166 is positioned at a pitch A2 from a front peg 32 of the above-mentioned peg unit 30A in the right-left direction. When the apparatus 20 is stopped at its working position, the full packaged roving bobbin FB mounted on the front peg 166 of the sub-peg unit 30A taking the most upstream position of the apparatus 20 with respect to its displacing direction Z takes a position below the supplemental rail 11 at one pitch A2 downstream to the group of almost exhausted roving bobbins suspended by the respective roving hangers of the bobbin carriage on the rail 11.

Next, the roving bobbin exchange operation carried by the above-mentioned apparatus according to a second embodiment of the present invention is explained in detail with reference to FIG. 28(*a*) to FIG. 28(*b*).

Before starting the spinning operation, full packaged roving bobbins FB and almost half exhausted roving bobbins MB are alternately supported by the bobbin hangers 7*a* of the front row of the bobbin hangers 7 and by the bobbin hangers 7*b* of the back row of the bobbin hangers 7 arranged in the creel portion on each side of the ring spinning frame 1, such that the size of a roving bobbin package of any bobbin hanger of the front row thereof is identical to that of the roving bobbin supported by the bobbin hangers which face the corresponding roving hanger of the back row of the roving bobbin hanger. When the above-mentioned half exhausted roving bobbins become almost exhausted, the roving bobbin exchange apparatus 20 reaches a working position along the corresponding one side of the spinning frame 1, in a direction from the side of the outer-end frame of the spinning frame 1 [in the direction indicated by arrow Y in FIGS. 28(*a*).....28(*b*)]. The apparatus 20 is first stopped at a position in front of the first three pairs Pl of the almost exhausted roving bobbins SB such that the first pair Pl of almost exhausted roving bobbins at a first position in the row of three pairs Pl of the almost exhausted roving bobbins SB faces the first peg unit 30A (utilized for handling almost exhausted roving bobbins SB) at a first position from the left in the row of three peg units 30A among the six peg units of the apparatus 20. In this condition, each of the front pegs 32 of three peg units 30A and three peg units 30B are respectively positioned below the corresponding full packaged roving bobbins F supported by three successive pairs P2 of the bobbin hangers supported by the supplemental rail 11. In this condition, each unit combination-device provided with the roving piecing head 100 and the suction nozzle 89 faces the pair of trumpets 14 which are supplying the rovings R1 from the corresponding pair Pl of the almost exhausted roving bobbins SB to the corresponding two adjacent draft parts of the ring spinning frame 1, and the pair of the roving guide members 145 face the pair of roving guides 9 which are supplying the above-mentioned rovings R1 respectively. Under the condition that the supporting bodies 36 are at the respective end points of their forward displacement motion, three peg units 30B (utilized for handling full packaged roving bobbins FB), are displaced upward from their standby positions S3 to their respective upper end positions S4, and during the above-mentioned lifting motion of the peg units 30B, the swing motors 39 of three peg units 30B are actuated so that each of the swing arms 38 are swung horizontally in the counterclockwise direction in the drawing, through the respective stationary gears 37 and the gears 40, so that the back pegs 41 are displaced to the respective displaced positions S2. Thereafter, the full packaged roving bobbins FB supported by the successive three pairs P2 of roving bobbins of the supplemental rail 11, which correspond to almost exhausted roving bobbins SB of the three pairs Pl, at respective positions for carrying out the roving bobbin exchange operation in the creel portion 2 of the spinning frame 1, are mounted on the front and back pegs 32 and 41 of the above-mentioned three peg units 30B. Next the motor 75 utilized for lifting the suction nozzle is driven so that the endless chains 78 are driven, the slide blocks 74 are displaced upward along inclined paths created by the guide rods 73, so that the cam follower 82 is guided by the plate cam 85 and the cam follower 86 is guided by the grooved cam 72 formed in the plate cam 85, and accordingly, the suction nozzles 89 are displaced upward together with the upward displacement of the slide blocks 74, by way of the pipe 79, and further, are displaced to the right-left direction (in FIG. 15) together with the pipe during the above-mentioned upward displacing motion, so that each suction nozzle 89 is displaced from the standby position S7 to the suction position S8 thereof, and the above-mentioned motion is stopped when each nozzle 89 arrives at the suction position S8, where the free end of each suction nozzle 89 is close to the peripheral surface of the corresponding one of the six full packaged roving bobbins FB. Then the suction source is actuated so that each suction nozzle 89 positioned at the suction position S8 starts a suction operation, the front pegs 32 and back pegs 41 are then rotated slowly by the action of the reversible motors 42 and 39, in the direction of rewinding the roving from the full packaged roving bobbins FB, simultaneously with the start of the actuation of the suction source. Due to the above-mentioned motion of the constitutional elements of the apparatus 20, each suction nozzle 89 sucks a free end of the roving from the corresponding full packaged roving bobbin FB, and then each suction nozzle 89 is displaced from the suction position S8 to the standby position S7 thereof below the corresponding roving piecing head 100, by an action reverse to the above action of the constitutional elements of the apparatus 20, while maintaining the suction. During this reverse motion of the constitutional elements of the apparatus 20, the full packaged roving bobbins FB are slowly rotated in the rewinding direction thereof. The free end of the rovings sucked into the respective suction nozzles 89 are carried along their passages in front of the respective roving guide members 145, and then gripped by the roving holding lever 103 of the roving piecing heads 100 and the corresponding one of the stopper blocks 106, respectively. In this condition, the roving from each full packaged roving bobbin FB mounted on a back peg 41 of each swing arm 38 is suspended from the horizontal portion 242*a* of the guide member 242 disposed in the corresponding roving separation guide 240 [see FIG. 28(*b*)].

In the successive operation, each roving piecing head 100 is swung from a suspended condition to a horizontal condition by the head swing cylinder 114, so that the gripped roving R2 is separated into two portions at a position between the suction nozzle 89 and the corresponding roving piecing head 100, by a comb (not shown) disposed in each suction nozzle 89 [see FIG. 28(*c*)].

When the roving guide member 145 is slightly displaced upward by the lifting motor 139 of the roving hanging device 130, the cam follower 145*a* is guided by the cam surface 144*a* so that the roving guide members 145 are displaced forward, and accordingly, each roving piecing guide member 145 enters a region of the roving R2 from the corresponding full packaged roving bobbin FB and the corresponding roving piecing head 100, each group of two rovings R2 is separated into a right side and left side on the inclined surface of each roving guide member 145, and the intermediate portion of the roving R2 is positioned in the recess 145*a* of the corresponding roving guide member 145. The arm 112 is displaced to the terminal point of the forward moving motion thereof by actuating the motor 117, and the roving guide member 145 is displaced to a position below the row of almost exhausted roving bobbins SB and the full packaged roving bobbins FB are rotated in the rewinding direction, whereby the roving piecing heads 100 are positioned at respective position above the corresponding trumpets to carry out a roving piecing operation thereat. Under this condition, each roving R2 from the corresponding full packaged roving bobbin FB, held in the grooved recess portion 102*b* of the corresponding roving piecing head 100, is doubled with the roving from the corresponding one of almost exhausted roving bobbins SB mounted on the three pairs Pl at the corresponding trumpet 14. The roving holding lever 103 of the roving piecing heads 100 is displaced to a non-operating position. In the above-mentioned operation, the roving R2 from the full packaged roving bobbin FB is released from the holding action of the roving holding lever 103, and thus the doubled portion of the rovings R1 and R2 is introduced into the trumpet 14, and the roving portion connected to the almost exhausted roving bobbin SB is separated from the doubled portion of the rovings R1 and R2. The above-mentioned roving piecing operation is carried out simultaneously at three adjacent pairs of almost exhausted roving bobbins of the creel portion at one side of the ring spinning frame 1 [see FIG. 28(*d*)].

Figure 20:
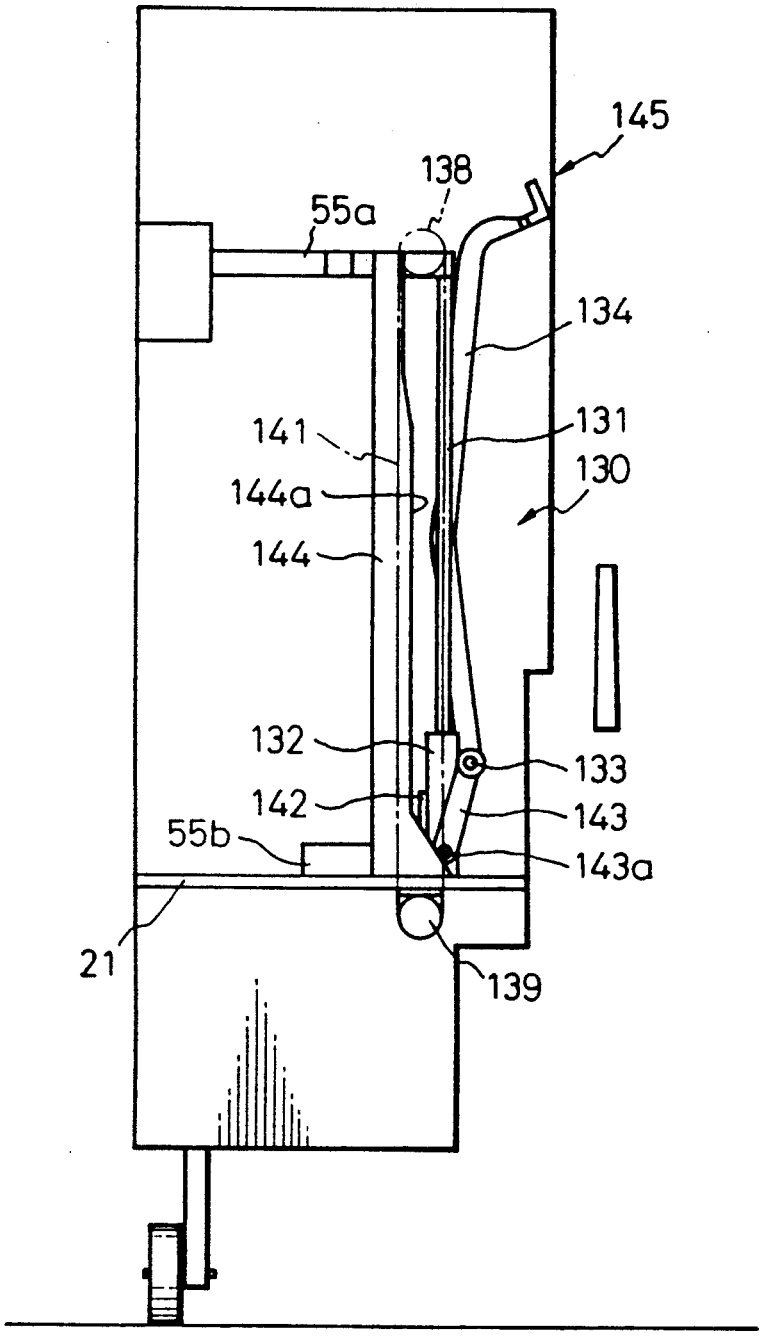
FIG. 20 is a side view of a roving transfer device utilized for the apparatus shown in FIG. 1.
Figure 21:
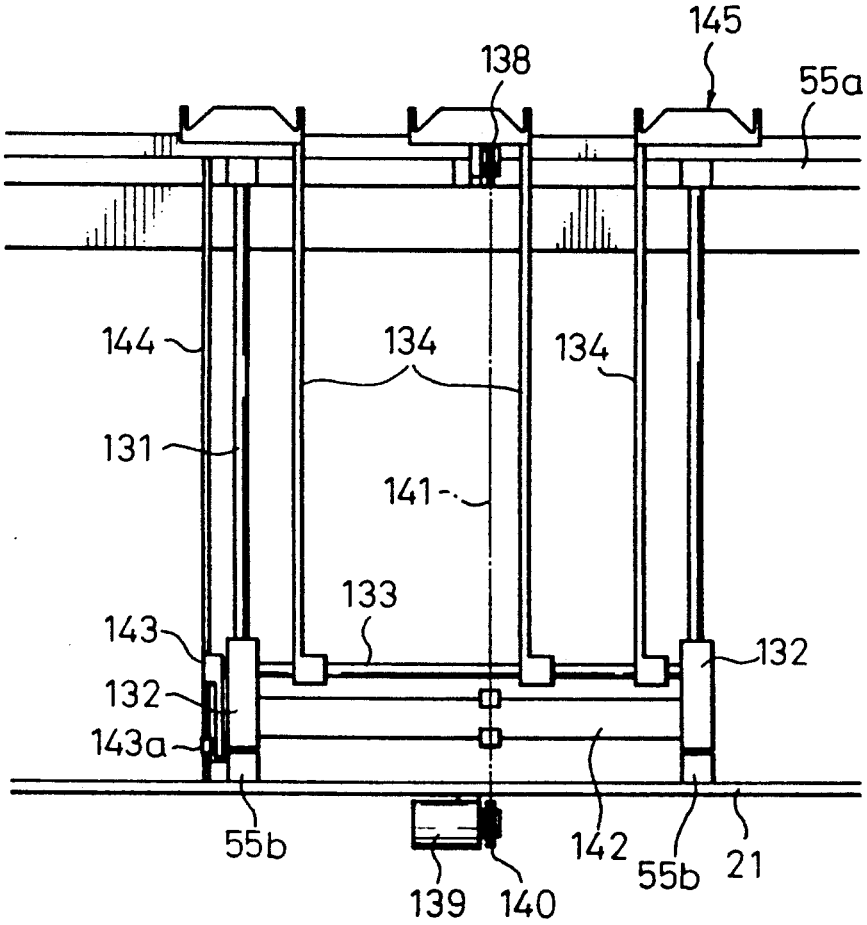
FIG. 21 is a front view of the roving transfer device shown in FIG. 20.

Next, the supporting body 36 of each peg unit 30B is brought into contact with the intermediate block 31*d* of the identical peg unit 30B, while maintaining the swing angle of the swing arm 38, so that the arrangement of the full packaged roving bobbins FB aligned [see FIG. 20(*e*)]at a position below the supplemental rail 11 is changed to a zig-zag condition as shown in FIG. 30(2). Then, while maintaining this arrangement of the full packaged roving bobbins FB, each swing arm 38 is turned so that corresponding back peg 41 is returned to the original position S1, whereby the relative arrangement of two adjacent full packaged roving bobbins FB is changed to the arrangement condition represented by Pl [FIG. 30(3)]. At this time, the radius of the swing motion of the full packaged roving bobbin FB mounted on the back peg of each supporting body 36 is reduced by an extent of the forward displacement motion of the supporting body 36, and therefore, even though the diameter of the full packaged roving bobbin FB is large and is close to the pitch A2, the change of the arrangement of the full packaged roving bobbins FB can be carried out without interference thereby with the full packaged roving bobbin FB mounted on the corresponding front peg 32.

Next, each roving holding lever 103 grips a roving R1 from the corresponding almost exhausted roving bobbin SB, by holding the same in a space between the corresponding stopper block 107, whereby the connection of the roving R1 to the almost exhausted roving bobbin SB is broken by feeding the roving R1 into the corresponding draft part of the spinning frame 1. Thereafter, the drive motor 50 for actuating the front-back displacing motion of the peg units 30A is driven to displace the peg units 30A forward, and due to this displacement motion of the peg units 30A, the front and back pegs of these peg units 30A are positioned at the respective positions below the corresponding pair Pl of almost exhausted roving bobbins SB [see FIG. 28(*e*)]. At this time, each doubled portion of the roving R2 is introduced to the side of the corresponding peg unit 30A by the guide portion of the roving separation guide 240 or the front-back bar 241 of the corresponding roving piecing head 100.

Thereafter, each peg unit 30A positioned below the almost exhausted roving bobbins SB is displaced upward and downward so that the almost exhausted roving bobbins SB of corresponding front-back pair Pl are taken from the respective bobbin hangers 7 of the creel portion 2 of the spinning frame 1 and are mounted on the corresponding front and back pegs 32 and 41 of the peg unit 30A. In this condition, the almost exhausted roving bobbins SB are rotated in the winding direction by rotating these pegs 31 and 41, and accordingly, the rovings R1 separated from the respective rovings introduced to the corresponding draft parts are wound thereon [see FIG. 28(*f*)]. Thereafter each peg unit 30A holding the almost exhausted roving bobbins SB is displaced backward so that each pair of almost exhausted roving bobbins SB, while maintaining the Pl relationship thereof, are positioned at respective positions adjacent to the corresponding front-back pair Pl of the full packaged roving bobbins FB.

The above explanation concerns a roving bobbin exchange operation applied to bobbin hangers in an intermediate portion of the row of the bobbin hangers, as shown in FIG. 29(*a*), the peg 166 located at a position right below the almost exhausted roving bobbin, which is suspended by the corresponding bobbin hanger of the bobbin carriage of the supplemental rail 11 is taken from the bobbin hanger by displacing upwards and the downwards and thereafter the above-mentioned almost exhausted roving bobbin is transferred to the waiting position S6.

Then, each roving piecing head 100 is returned to the standby position in the vertical condition, and each roving guide member 145 is displaced upward so that each roving R2 located at a position downstream of the corresponding roving guide member 145 is introduced into the corresponding roving guide 9 from the opening 8 thereof. Then the corresponding two guide members 145 are displaced toward each other by the action of the two air cylinders 147, and the roving guide member 145 is retracted so that the rovings R2 are hung inside the hook portions 9*a* of the corresponding roving guides 9, respectively, as shown in FIG. 29(*b*) and FIG. 25 (indicated by two-dot row). Next, the roving bobbin exchange apparatus 20 is displaced to the next working position by the front-back pitch A2 along the parallel rows of front bobbin hangers *7a* and the back bobbin hangers *7b*, and each roving guide member 145 is returned to the standby position thereof, and thereafter, the three peg units 30B holding the full packaged roving bobbins FB are displaced downward to the standby positions S3. Accordingly, each pair Pl of front-back full packaged roving bobbins FB on the three peg units 30B of the apparatus 20 are respectively positioned facing the corresponding pair of bobbin hangers *7a* and *7b* of the creel portion 2 of the spinning frame 1, from which the almost exhausted roving bobbins SB were taken off [see FIG. 29(*c*)]. At this time, since the almost exhausted roving bobbins RB supported by the corresponding bobbin hangers of the supplemental rail 11 are positioned at the respective standby position S6 thereof, none of the roving bobbins of the apparatus 20 will interfere with the almost exhausted roving bobbins SB supported by the bobbin hangers of the supplemental rail 11, and accordingly, the supplemental rail can be arranged at a preferable lower position in front of the spinning frame 1.

Next, each peg unit 30B having the full packaged roving bobbins FB is displaced forward, to take the corresponding front-back bobbin hangers *7a*, *7d* of the creel portion 2 of the spinning frame 1, and these peg units 30B are then displaced upward and downward to transfer the full packaged roving bobbins FB from the pegs of the peg units 30B to the corresponding bobbin hangers *7a* or *7b* of the creel portion 2 of the spinning frame 1 [see FIG. 29(*d*)]. Thereafter, the three peg units 30B are simultaneously displaced backward, and then the apparatus 20 is displaced by one pitch A2, which coincides with a pitch between two adjacent bobbin hangers of an identical row thereof in the creel portion 2, toward the left in the drawing, and the following operation for the almost exhausted roving bobbins SB is simultaneously carried out. Namely, each peg unit 30A supporting the almost exhausted roving bobbins SB is displaced upward, while the corresponding swing arms 35 are turned so that the back peg 41 of each peg unit 30A is angularly displaced from the original position S1 to the displaced position S2, with the almost exhausted roving bobbin SB mounted thereon. Due to the operation of the three peg units 30A, the arrangement of the three pairs Pl of front-back almost exhausted roving bobbins SB is changed to an arrangement of three pairs P2, having a right-left relationship, of the respective two almost exhausted roving bobbins SB, i.e., one row of almost exhausted six roving bobbins SB, and accordingly, these almost exhausted roving bobbins SB are easily transferred to the bobbin hangers 12 of the supplementary rail 11 [see FIG. 29(*e*)]

After the apparatus 20 is displaced by one pitch A2 toward the left of FIG. 29, the almost exhausted roving bobbins positioned at the standby positions S6 are returned to the positions S5 below the corresponding bobbin hangers 12 of the supplemental rail 11 by the action of the cylinder 164, whereby these almost exhausted roving bobbins SB are transferred to the corresponding bobbin hangers 12. Thereafter, the back peg 41 of each peg unit 30A is displaced from the displaced position S2 to the original position S1, and thus one cycle of the unit roving bobbin exchange operation by the apparatus 20 is completed [see FIG. 29(*f*)]. The above-mentioned unit roving bobbin exchange operation is repeated by displacing the apparatus by a unit pitch which is six times the pitch between two adjacent bobbin hangers *7a* (*7b*) of the two parallel rows thereof in the creel portion 2 of the spinning frame, toward the left side, and the unit roving bobbin exchange operation is carried out when the apparatus is stopped after one displacement thereof.

In the above-mentioned embodiment, the following modifications can be applied. In each step of the roving bobbin exchange operation, the main body 21 of the apparatus 20 may be held at each working position for carrying out one unit roving bobbin exchange operation thereof and while being held, each peg unit, formed by a first sub-peg unit and second sub-peg unit, may move one pitch A2 along the spinning frame 1. Alternatively, the main body 21 of the apparatus, which supports a roving bobbin at the position S6, may move one pitch A2 along the spinning frame 1 at the above-mentioned working position. In this case, the above-mentioned peg units do not undergo the above-mentioned displacing motion along the spinning frame 1.

Next, another method of carrying out the roving bobbin exchange operation utilized by the apparatus 20 of the above-mentioned first embodiment is explained in detail, with reference to FIG. 31.

In this modified operation, the apparatus 20 is stopped at each predetermined position [see FIG. 31(*a*)], then three successive pairs of full packaged roving bobbins FB are taken from the bobbin hangers 13 (not shown) of the bobbin carriage 12 (not shown) of the supplemental rail 11 (not shown) and displaced on the pegs of the corresponding sub-peg unit 30A (30B) of the apparatus 20 (not shown). After carrying out the roving piecing operation mentioned in the explanation of the first embodiment, three pairs of almost exhausted roving bobbins SB are taken from the bobbin hangers of the spinning frame 1 and mounted on the corresponding pegs of the corresponding sub-peg unit 30A mounted on the apparatus 20. These sub-peg units 30A take the respective positions shown in FIG. 31(*b*). Thereafter, a full packaged roving bobbin FB, supported by a bobbin hanger of the supplemental rail 11 (not shown) at a position adjacent to a bobbin hanger, supporting a full packaged roving bobbin FB at a position right above an outside peg of a first sub-peg unit 30A of the three sub-peg units 30A of the apparatus 20 (not shown) in the displacing direction of the apparatus 20 (not shown) is taken from the above-mentioned bobbin hanger of the supplemental rail 11 and the displaced to the standby position S6 on the apparatus 20 (not shown). Thereafter, the apparatus 20 (not shown) is displaced by one pitch A2 in the Z direction in FIG. 31(*b*), and thereafter a pair of full packaged roving bobbins FB are mounted on the corresponding outside and inside bobbin hangers *7a*, *7b* (not shown) of the spinning frame 1. These full packaged roving bobbins FB are displaced by the action of the pegs of the sub-peg units 30A as shown in FIG. 31(*c*). Thereafter, the arrangement of each pair of almost exhausted roving bobbins SB is changed to an arrangement along the lengthwise direction of the supplemental rail 11 (not shown) and then the apparatus 20 (not shown) is displaced toward a direction *Za* [FIG. 31(*c*)] opposite to the direction Z and mounted on the corresponding bobbin hangers of the supplemental rail 11 (not shown). This condition is indicated in FIG. 31(*d*).

Figure 32A:
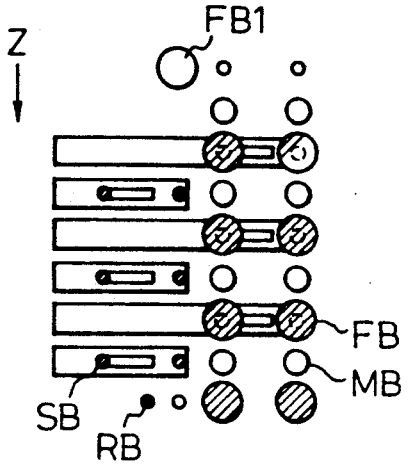
FIGS. 32(*c*) and (*d*) are explanatory views indicating the second roving bobbin exchange operation carried out by a modified roving bobbin exchange method according to the present invention.
Figure 32B:
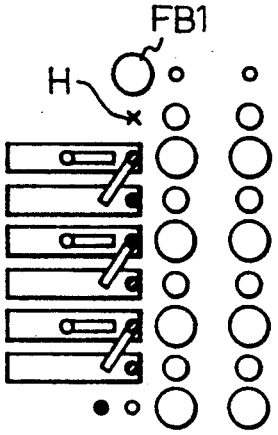

Another modified roving bobbin exchange method utilized by the above-mentioned roving bobbin supporting device 160, which is operated in the left side of the spinning frame 1, is explained in detail. In this modified method, the first unit operation, the second unit operation, the last unit operation, and intermediate unit operations from the third unit operation to the unit operation right before the last unit operation are carried out in different modes. That is, the first unit operation is carried out in the mode identical to that of the above-mentioned first embodiment of the present invention, in other words, the first unit operation does not involve the process of temporarily transferring the almost exhausted roving bobbins on the corresponding bobbin hangers of the supplemental rail 11 and the process of returning the roving bobbins to the corresponding bobbin hangers of the supplemental ring 11. In the second unit operation, the processes from the operation of taking six full packaged roving bobbins from the bobbin hangers of the supplemental rail 11 to the operation of mounting the full packaged roving bobbins FB on the corresponding pair of bobbin hangers *7a*, *7b* are identical to the first embodiment as shown FIGS. 28(*a*) to (*f*) and FIGS. 29(*a*) to (*d*). In the operations after mounting the full packaged roving bobbins FB on the pegs of the corresponding sub-peg units 30B [see FIG. 32(*a*)], the arrangement of each pair of almost exhausted roving bobbins SB is changed in the direction of its arrangement to the direction along the right and left direction without displacing the apparatus 20 in the right direction by one pitch, and mounting these almost exhausted roving bobbins SB on the bobbin hangers of the supplemental rail 11, so that six almost exhausted roving bobbins SB are suspended by the successive bobbin hangers of the supplemental rail 11 at a portion one pitch different toward the Z direction concerning the apparatus 20, so that an adjacent bobbin hanger H of the supplemental rail 11 to the successive six bobbin hangers supporting the above-mentioned six almost exhausted roving bobbins SB in the right side becomes free to receive a roving bobbin [see FIG. 32(*b*)].

Figure 33A:
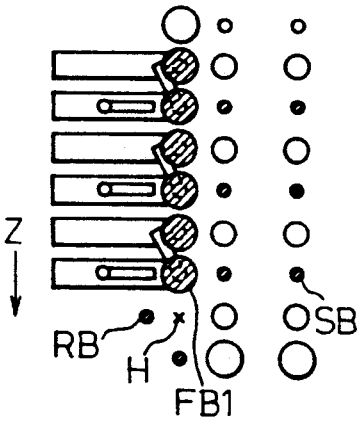
FIGS. 33(*a*) to (*c*) are explanatory views indicating an intermediate stage of the roving bobbin exchange operation of the modified method carried out by the apparatus shown in FIG. 1.
Figure 33B:
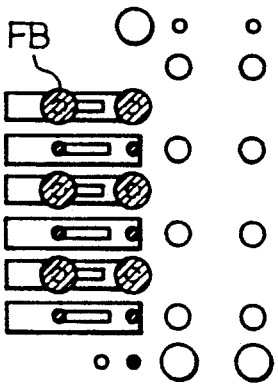
Figure 33C:
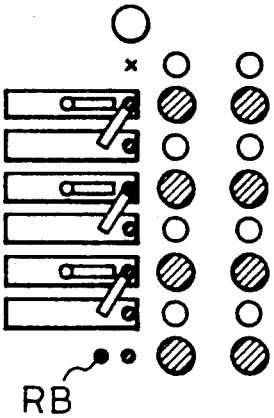

In each of the above-mentioned many intermediate unit operations, the roving bobbin exchange operation is started from the condition indicated in FIG. 33(*a*) wherein an almost exhausted roving bobbin SB is positioned at the standby position S6, and the processes indicated in FIGS. 28(*b*) to FIG. 28(*f*) are carried out. Next, after the almost exhausted roving bobbins SB are taken from the bobbin hangers of the creel portion of the spinning frame and the sub-peg units take their original positions on the apparatus 20, the full packaged roving bobbins FB supported by the respective sub-peg units 30B take their respective positions right below the corresponding bobbin hangers of the spinning frame 1 [see FIG. 33(*b*)]. After the above-mentioned full packaged roving bobbins FB are mounted on the bobbin hangers *7a*(*7b*), in each sub-peg unit 30B, the almost exhausted roving bobbin SB supported by the peg of the back side is displaced to a position in a row of the almost exhausted roving bobbins SB supported by the pegs of the front side of the sub-peg units 30B so that six successive almost exhausted roving bobbins SB take the positions right below the corresponding bobbin hangers of the supplemental rail 11. During the above-mentioned operation of displacing the almost exhausted roving bobbins SB, the apparatus 20 is not displaced. In this condition, the above-mentioned six almost exhausted roving bobbins SB are successively mounted to the bobbin hangers 12 of the supplemental rail 11 as shown in FIG. 33(*c*).

Figure 34A:
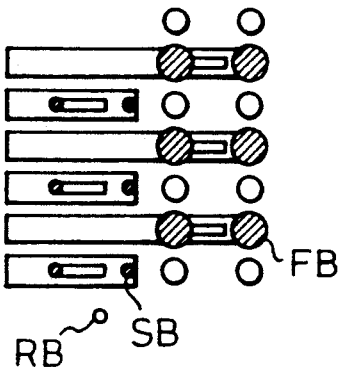
FIGS. 34(*a*) and (*b*) are explanatory views indicating a final stage of the roving bobbin exchange operation of the modified method carried out by the apparatus shown in FIG. 1.
Figure 34B:
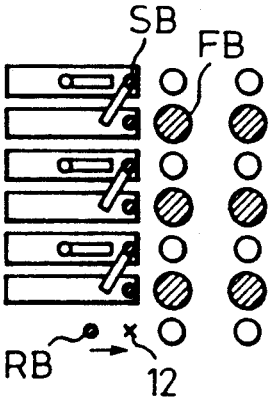

In the last unit roving bobbin exchange operation, the operations identical to the operation of each of the above-mentioned intermediate unit operations is carried out until the full packaged roving bobbins FB are mounted on the respective pairs of the bobbin hangers arranged in the creel portion of the spinning frame 1 [see FIG. 34(*a*)]. Thereafter, the arrangement of each pair of the almost exhausted roving bobbins is changed to the right and left arrangement P2, and simultaneously each peg unit is displaced one pitch to the direction reverse to the direction Z so that the above-mentioned six almost exhausted roving bobbins SB become to able to be mounted on the corresponding bobbin hangers 12 of the supplemental rail 11. After mounting the almost exhausted roving bobbins SB on the corresponding bobbin hangers 12 of the supplemental rail 11, the almost exhausted roving bobbin SB positioned at the standby position S6 is returned to a free bobbin hanger 12 of the supplemental rail 11 simultaneously so that the unit roving exchange operation is completed [see FIG. 34(*b*)].

In the above-mentioned roving bobbin exchange method, when the main body 21 of the apparatus 20 is displaced by one pitch A2 along the lengthwise direction of the spinning frame 1 for facing each pair of full packaged roving bobbins FB mounted on the sub-peg units 30B to the corresponding pair of bobbin hangers (outside and inside bobbin hangers) in the creel portion of the spinning frame 1, none of the roving bobbins mounted on the apparatus 20 are interfered with by the roving bobbins RB of the supplemental rail 11. Except for the first and the last unit operations, since the apparatus 20 is not displaced after the full packaged roving bobbins FB are mounted on the bobbin hangers 7(*7a*, *7b*) in the creel portion 2 of the ring spinning frame 1, the time required for the operation of correctly positioning the apparatus 20 at each time of step displacing motion thereof is reduced so that the time required to complete the entire operation of exchanging the roving bobbins in the spinning frame 1 is reduced.

Figure 35:
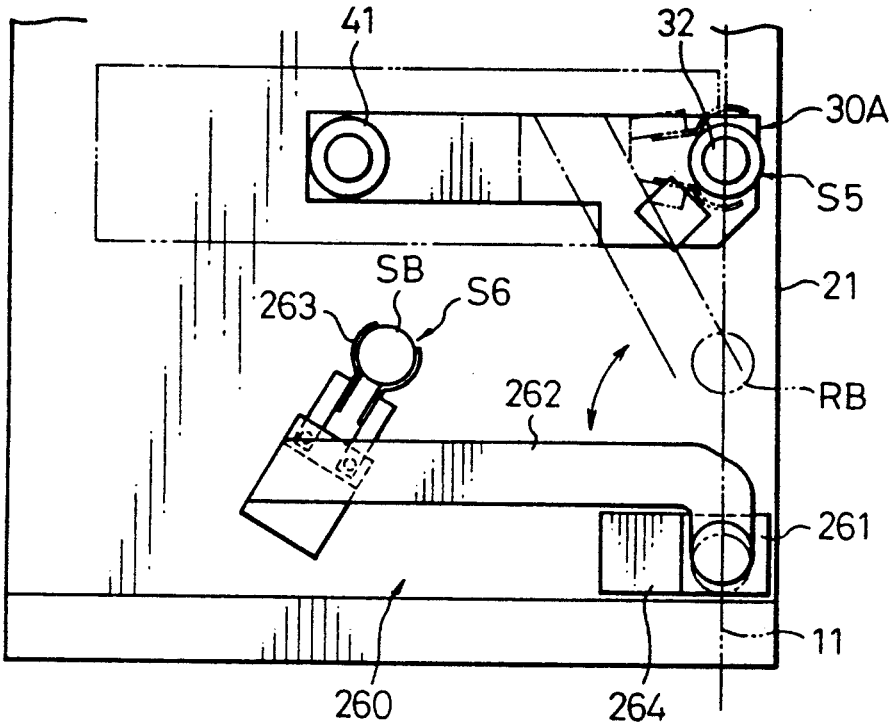
FIG. 35 is a plan view of a modified device for reserving roving bobbins utilized in the apparatus shown in FIG. 1.
Figure 36:
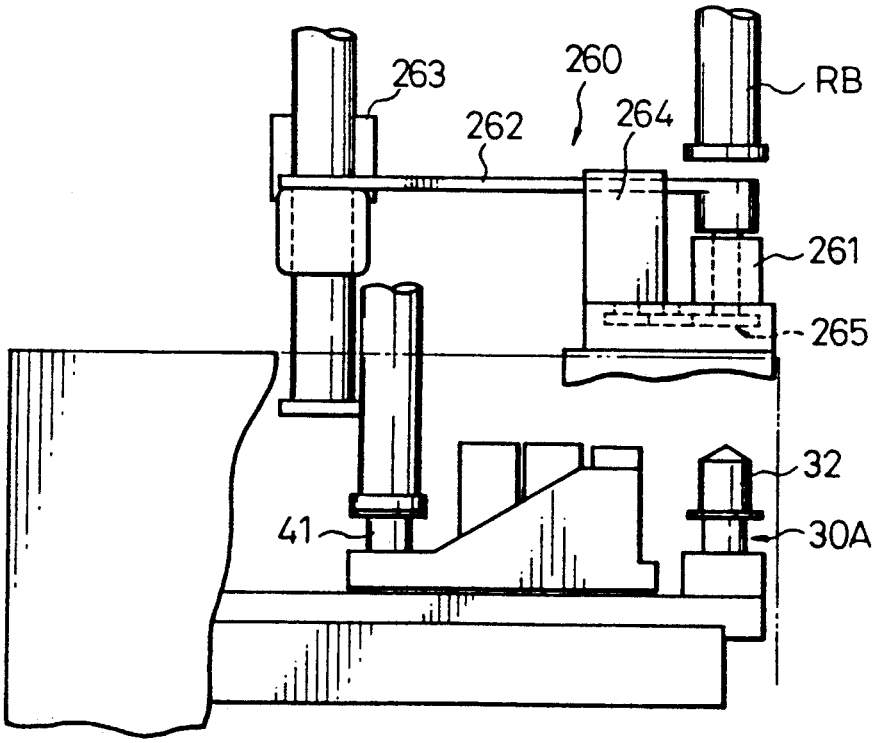
FIG. 36 is a side view of the device shown in FIG. 35.

In another embodiment of the device for temporarily holding roving bobbin in the apparatus 20 shown in FIGS. 35 and 36, the almost exhausted roving bobbin supported by the outside bobbin hanger *7a* of a pair of bobbin hangers (outside and inside) of the spinning frame 1, which take a position facing the first one of three sub-peg units 30B in the direction of displacing the apparatus 20, is temporarily reserved in the apparatus 20. The above-mentioned device 260 is provided with a base 261, an arm 262 which is turnably mounted on the base 261 in a horizontal condition, and a gripper 263, which is provided with two gripping fingers, secured to the free end portion of the arm 262. The horizontal swing motion of the arm 262 is actuated by a motor 254 secured to the base 261 by way of the gear train 265 so that the swing motion of the gripper 263 between a position S5, positioned right above the front peg 32 of the second sub-peg unit 30A which is located at the end portion of the apparatus 20 with respect to the direction of the displacement of the apparatus 20, and the standby position S6 positioned left from a position right below the supplemental rail 11, is created. The height of the device 260 is so designed that the apparatus 20 is capable of passing through a space below the roving bobbins suspended by the bobbin hangers of the supplemental rail 11.

The roving bobbin exchange method utilized by the apparatus 20 provided with the above-mentioned device 260 is explained in detail below, however, only the characteristic features different from the above-mentioned method explained already are explained.

Each sub-peg unit 30A whereon a pair of almost exhausted roving bobbins SB is mounted is displaced to the corresponding position adjacent to the corresponding sub-peg unit 30B whereon a pair of full packaged roving bobbins FB is mounted. The almost exhausted roving bobbin SB, which is supported by the front peg of the first sub-peg unit 30A of the apparatus located at the displacing direction of the apparatus 20 is gripped by the gripping elements of the gripper 263 of the device 260. The peg unit 30A is displaced downward while maintaining the above-mentioned gripping condition by the gripper 263, toward its standby position, so that the almost exhausted roving bobbin SB is taken from the front peg 32 of the sub-peg unit 30A, so that the almost exhausted roving bobbin SB is transferred to the standby position S6 by the action of the arm 262 [see FIG. 37(*a*)]. Thereafter, the main body 21 of the apparatus 20 is displaced by one pitch A2 so that the pair of full packaged roving bobbins FB mounted on each sub-peg unit 30B faces the corresponding pair of outside and inside bobbin hangers 7*a* and 7*b* from which the almost exhausted roving bobbins have been taken off [see FIG. 37(b)], however, possible interference between the roving bobbins suspended by the bobbin hangers of the supplemental rail 11, which condition was made by the previous roving bobbin exchange operation, and any roving bobbins of the apparatus 20 is prevented.

Figure 37A:
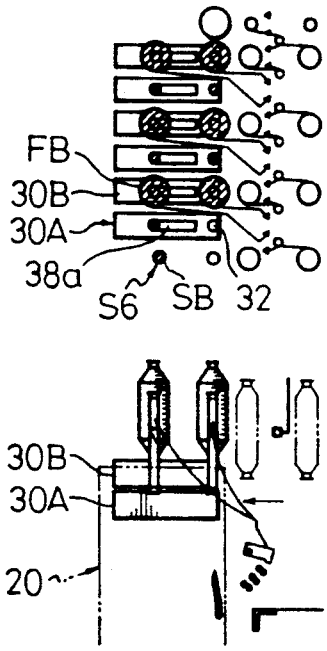
FIG. 37(*a*) to (*c*) an explanatory views indicating a modified method of exchanging the roving bobbins by the apparatus shown in FIG. 1.
Figure 37B:
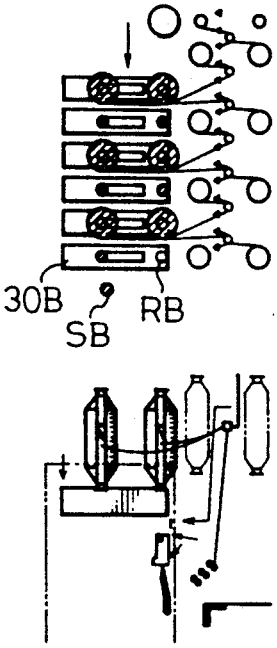
Figure 37C:
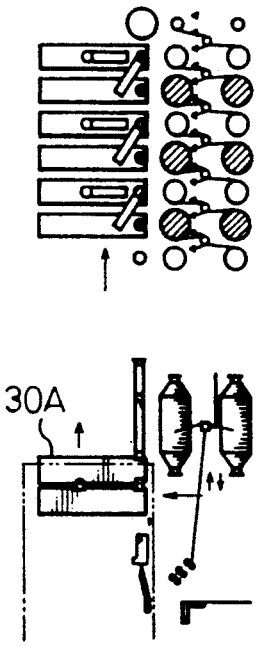
Figure 38A:
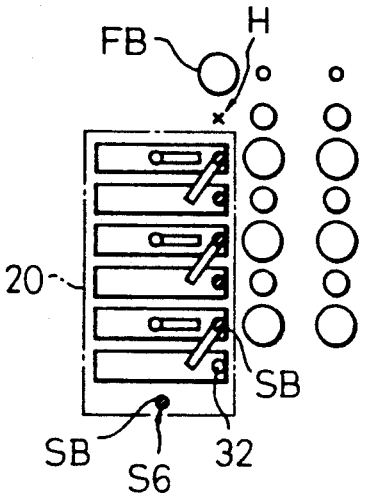
FIGS. 38(*a*) nd (*d*) are explanatory views indicating a further modified method of exchanging the roving bobbins by the apparatus shown in FIG. 1.
Figure 38B:
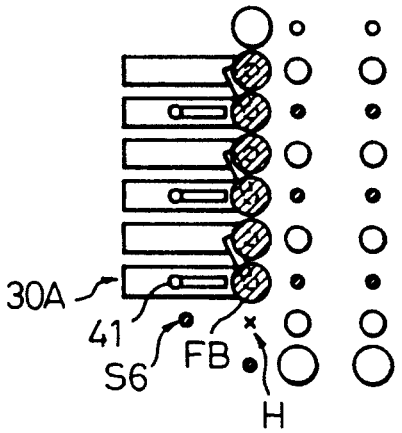
Figure 38C:
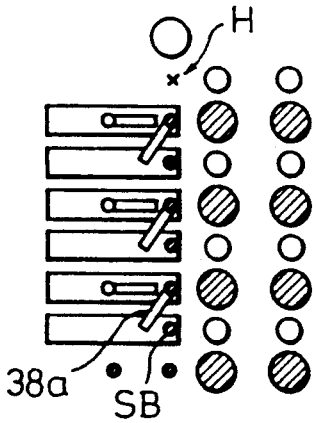
Figure 38D:
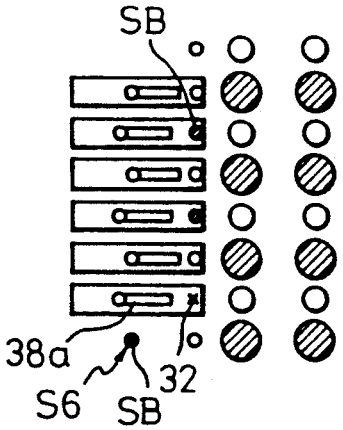

On the other hand, the almost exhausted roving bobbin SB reserved at the standby position S6 is returned to the front peg 32 of the sub-peg unit 30A positioned at the right end side of the apparatus 20 by the swing motion of the arm 262, the gripping operation of the gripper 263, and the upward motion of the sub-peg unit 30A, and then the apparatus 20 is displaced to the left direction [in FIG. 37 (*c*), upward direction indicated by an arlow] along the spinning frame by one pitch A2, which is a pitch between the bobbin hangers of the spinning frame 1. The sub-peg units 30A holding the almost exhausted roving bobbins SB are simultaneously displaced upward, while the swing arm 38*a* is turned so that the back peg 41 holding the almost exhausted roving bobbin SB is displaced from its original position S1 to the displaced position S2. Accordingly, the arrangement of two almost exhausted roving bobbins SB of each sub-peg unit 30A is changed to a right-left arrangement thereof, in other words, six almost exhausted roving bobbins SB supported by the sub-peg units 30A are arranged in a row along the supplemental rail 11. Thereafter the above-mentioned almost exhausted roving bobbins SB are mounted on the corresponding bobbin hangers 12 of the supplemental rail 11 from which the full packaged roving bobbins FB have been taken [see FIG. 37(*c*)]. In this method, it is unnecessary to reserve an almost exhausted roving bobbin SB at the standby position when the roving bobbin exchange operation is carried out and return it to its original position after completion of one unit roving bobbin exchange operation.

Next, a further different roving bobbin exchange operation utilizing the roving bobbin reserving device 269 is explained in detail with reference to FIG. 38. In this method, the unit operations are different from each other between the first unit portions, the last unit operation, and the intermediate unit operation between the first and last unit operations. That is, in the first unit operation, after the full packaged roving bobbins FB are mounted on the pegs of the sub-peg units 30A, the almost exhausted roving bobbins SB standing by at the position S6 are not returned to the front peg 32 of the sub-peg unit 30A positioned at the right end side of the apparatus 20. On the other hand, the apparatus 20 is not displaced to the left side direction by one pitch A2. Under such a condition, the arrangement of two almost exhausted roving bobbins SB mounted on the front and back pegs 32, 41 of each sub-peg unit 30A is changed to the arrangement along the right and left direction at the positions on the apparatus 20. These almost exhausted roving bobbins SB are mounted on the bobbin hangers of the supplemental rail 11. Accordingly, five almost exhausted roving bobbins SB, which are suspended from the bobbin hangers of the supplemental rail 11 as mentioned above, from the right side end [upper side in FIG. 38(*a*)] of the apparatus 20 are positioned facing the corresponding one of the five pairs of outside and inside bobbin hangers of the spinning frame 1, respectively.

Next, in each one of the intermediate unit operations, the roving exchange operation is started with the almost exhausted roving bobbin SB reserved at the standby position S6 on the apparatus 20. The full packaged roving bobbins FB face to the corresponding front and back bobbin hangers of the spinning frame 1, from which the almost exhausted roving bobbins SB have been taken off, by the operation of the sub-peg units 30B, without displacing the apparatus 20 along the lengthwise direction of the spinning frame 1. After the full packaged roving bobbins FB are mounted on the bobbin hangers of the spinning frame, six almost exhausted roving bobbins SB mounted on the sub-peg units 30A are mounted on the corresponding bobbin hanger of the supplemental rail 11 with these six almost exhausted roving bobbins SB positioned in a biased condition toward the right direction [downward direction in FIG. 38(*b*)].

In the last unit operation, until the full packaged roving bobbins FB are mounted on the corresponding bobbin hangers of the spinning frame 1, operations similar to the above-mentioned intermediate unit operation are carried out, and thereafter the arrangement of each pair of almost exhausted roving bobbins SB is changed to the right-left arrangement and simultaneously these almost exhausted roving bobbins mounted on the corresponding sub-peg units 30B are displaced to the left side by displacing the apparatus 20 by one pitch A2. Under such a condition, these almost exhausted roving bobbins are mounted on the corresponding bobbin hangers of the supplemental rail 11. Next, the swing arm 39*a* of each sub-peg unit 30A is returned to its original position and the apparatus 20 is simultaneously displaced to the right side direction by one pitch A2. Then, the above-mentioned three peg units 30A are displaced upward so that two almost exhausted roving bobbins SB indicated by hatching in FIG. 38(*b*) are taken from the bobbin hangers of the supplemental rail 11, the almost exhausted roving bobbin SB which has been reserved in the apparatus 20 is returned to the front peg 32 of the sub-peg unit 30A positioned at the right end of the apparatus 20, and three exhausted roving bobbins SB are mounted on the corresponding bobbin hangers of the supplemental rail 11.

In the above-mentioned embodiment, after the almost exhausted roving bobbins SB are mounted on the bobbin hangers 12 of the supplemental rail 11 from which the full packaged roving bobbins FB have been taken off, the following modification can be applied, that is, one supplemental bobbin hanger is additionally mounted on the supplemental rail 11 so that the operation for transferring one roving bobbin to the standby position in the apparatus 20 in the first unit operation and the operation for transferring the roving bobbin from the standby position on the apparatus to the bobbin hanger of the supplemental rail 11 and the one pitch A2 apparatus 20 in the first and the last unit operations can be omitted.

Figure 39:
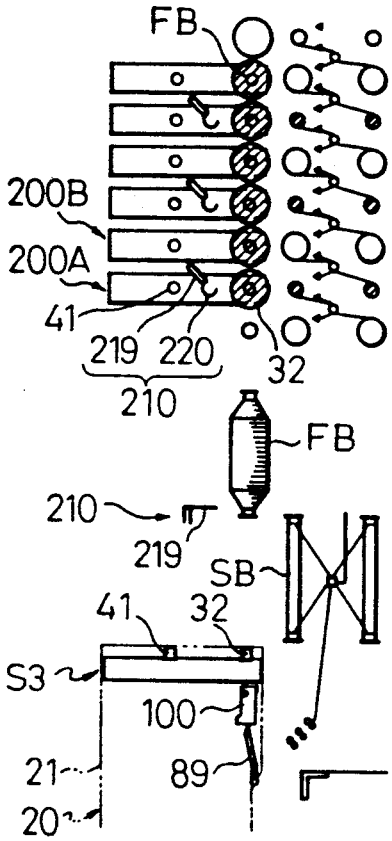
FIG. 39 is an explanatory view of the arrangement of a bobbin displacing device.
Figure 40:
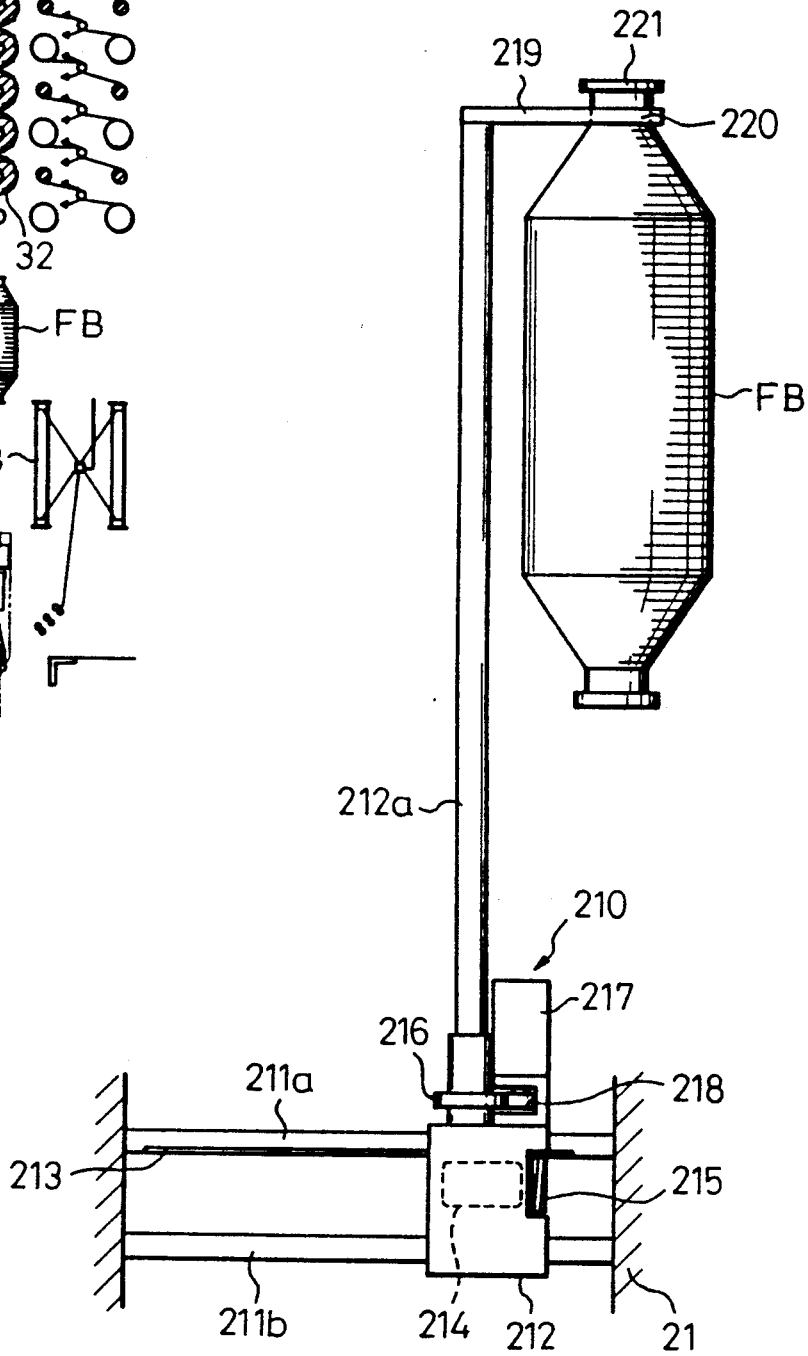
FIG. 40 is a side view of a bobbin displacing device.

In the drawings of FIGS. 39 and 40, which show the roving bobbin transferring device 210 of the roving bobbin displacing device by which the operation for exchange roving bobbins between a right and left pair of roving bobbins and a front and back pair of roving bobbins is carried out, a pair of horizontal guide rods 211*a* and 211*b* extending in the front and back direction are roughly disposed on the main body 21 at an intermediate position between the sub-peg unit 30A and the sub-peg unit 30B. A sliding body 212 is slide along the front and back direction on the guide rods 211*a* and 211*b*. The guide rod 211*a* is provided with a worm rack 213 at the bottom portion thereof along the lengthwise direction, which worm rack 213 meshed with a worm gear 215 of a drive motor 214. A bottom of a pillar 212*a* is rotatably mounted on the side body 212. A gear 216 is formed at the bottom end of the pillar 212*a* as one body thereto meshed with a drive gear 218 of a torque motor 217. A suspension arm 219 is connected at its bottom portion to the upper end of the pillar 212*a*. An engaging member 220 is formed at the free end portion of the suspension arm 219 for suspending a roving bobbin by engagement thereto. The turning angle of the suspension arm 219 is designed such that, when the suspension arm 219 is turned in a condition maintaining its position at the terminal point of its backward displacement in the front and back direction or at the terminal point of the forward displacement in the front and back direction, the engaging portion 220 takes a position right above the back peg 41 or the front peg 32 of the sub-peg units 200A, 200B which form a pair. In the bobbin transferring device 210, six full packaged roving bobbins are displaced downward to the respective standby positions corresponding to the standby position S3, by simultaneously displacing six sub-peg units 200A and 200B upwards. After carrying out the operation of taking the respective roving ends from the corresponding full packaged roving bobbins FB mentioned above, and then carrying out the roving piecing operation, the roving suspension arm 219 positioned at an intervened position between the front peg 32 and the back peg 41 of the sub-peg unit 200A utilized for an almost exhausted roving turned clockwise slightly by actuating the motor 217 and the arm 219 is simultaneously displaced forward by rotating the worm rack 213 and the worm gear 215. The arm 219 is then turned counterclockwise at the terminal position of the above-mentioned forward motion, and the engaging portion 220 engages with an upper flange 221 of the corresponding full packaged roving bobbin FB mounted on the corresponding sub-peg unit 200A which is mainly utilized for the almost exhausted roving bobbins SB. Thereafter, six sub-peg units 200A and 200*b* are simultaneously displaced downward, the full packaged roving bobbin Fb mounted on the above-mentioned sub-peg unit 200A are transferred to the engaging portion 220 of the respective suspension arms 219 so that an intervened space is created between the bottom of each suspended full packaged roving bobbin FB and the corresponding peg 32 or 41 of the sub-peg unit 200A. In this condition, each suspension arm 21 is displaced backward and turned counterclockwise at the terminal position of the above-mentioned backward displacing motion thereof, and this turning motion is stopped when the axial position of the full packaged roving bobbin FB coincides to the axial row of the back peg 41 of the sub-peg unit 200B, which is mainly utilized for the full packaged roving bobbin FB. In the above-mentioned operation, the position of the suspended full packaged roving bobbin FB of course takes a position above the above-mentioned back peg 41 of the sub-peg unit 200B. Thereafter, the sub-peg unit 200B is only displaced upward so that the above-mentioned suspended full packaged roving bobbin FB is mounted on the back peg 41 of the corresponding sub-peg unit 200B. According to the above-mentioned operations, each right and left pair arrangement of the full packaged roving bobbins on the corresponding sub-peg unit 200B is changed to an arrangement of a front back relation so that three pairs Pl of full packaged roving bobbins FB arranged in the front and back relation are created. If the arrangement of almost exhausted two roving bobbins SB in the front and back relation is required to the arrangement in the relation of right and left, the successive operations reverse to the above-mentioned successive operations are applied.

In the above-mentioned embodiment, a device is provided for temporarily holding roving bobbins to prevent possible interference between the roving bobbins in the apparatus with the roving bobbins of the supplemental rail, however, such a device and the operations related to such a device can be omitted by arranging the supplemental rail at a position high enough to prevent the above-mentioned interference during the successive operations to carry out the roving bobbin exchange operation.

As has become clear from the explanation of the embodiments of the present invention, according to the present invention, the unit operation of carrying out the roving bobbin exchange operation, which is applied to a pair of two roving bobbins facing each other in the creel portion of a spinning frame, can be satisfactorily performed in a limited working space defined by double the pitch between two adjacent bobbin hangers of front or back row of bobbin hangers a long the lengthwise direction of the spinning frame. Therefore, a number of unit roving bobbin exchange operations can be simultaneously carried out to a corresponding plurality of successive pairs of almost exhausted roving bobbins of the creel portion of a spinning frame with the full packaged roving bobbins of the supplemental rail. Accordingly, the most remarkable advantage of the present invention is to be able to remarkably reduce the time required to complete the entire roving bobbin exchange operation in a spinning frame.

Moreover, the position of the supplemental relative to the creel portion of the spinning frame can be made lower than in the conventional system because before the apparatus is displaced by one pitch in the lengthwise direction of the spinning frame so as to each made pair of front and back full packaged roving bobbins mounted on the sub-peg units the corresponding pair of bobbin hangers (front and back roving bobbins facing each other) of the creel portion of the spinning frame, from which the almost exhausted roving bobbins have been taken off, a front roving bobbin of a first sub-peg unit located at an end of the apparatus with respect to the displacing direction thereof, or a roving bobbin of the supplemental rail which is adjacent to a roving bobbin of the supplemental rail facing the above-mentioned roving bobbin of the sub-unit peg in the displacing direction of the roving bobbin exchange apparatus, is transferred to a standby position separated from a position right below the supplemental rail. Therefore no roving bobbins taken from the corresponding bobbin hangers of the creel portion of the spinning frame, while maintaining the level of the full packaged roving bobbins taken from the supplemental rail at the same level as the roving bobbins mounted on the bobbin hangers of the creel portion of the spinning frame, overlaps a roving bobbin of the supplemental rail. Accordingly the arrangement height of the supplemental rail can be designed a little lower than the level of arranging the bobbin hangers on the creel portion of the spinning frame. In other words, since the level difference between the roving bobbins of the creel portion of the spinning frame and the roving bobbins of the supplemental rail becomes small, the lifting distance of the roving bobbins at the time of carrying out the roving bobbin exchange operation can be reduced. The advantage of the present invention contributes to concerning the speed of the roving bobbin exchange operation. On the other hand, since the position of the supplemental rail can be designed to lower positions as mentioned above, the arrangement position of the bobbin hangers of the supplemental rail can be at almost the same level as the arrangement of bobbin hangers of the creel portion of the spinning frame, so the roving bobbin exchange operation according to the present invention can be carried out very effectively in a more stable condition.

We claim:

1. In a method of exchanging roving bobbins for a ring spinning frame provided with a plurality of draft parts arranged in alignments along a lengthwise direction at each side of said spinning frame, wherein an inner-side and an outer-side of said spinning frame define a back-side and a front-side of said spinning frame, respectively, a creel portion including front and back rows of bobbin hangers arranged along said alignment of draft parts at each side of said spinning frame, having an identical pitch (A2) between two adjacent bobbin hangers in each row of said bobbin hangers, a supplemental rail, arranged along the two rows of bobbin hangers at each side of said spinning frame, for receiving a bobbin carriage provided with a plurality of bobbin hangers arranged in a row having said pitch (A2);

wherein said method comprises:

(a) alternately suspending full packaged roving bobbins (FB) respective pairs of bobbin hangers of said creel portion, each pair of said bobbin hangers being formed by a front bobbin hanger of said front row of bobbin hangers and a back bobbin hanger of said back row of bobbin hangers which faces said front bobbin hanger in a direction perpendicular to the lengthwise direction of said spinning frame;

(b) alternately suspending almost half exhausted roving (MB) on respective remaining pairs of said bobbin hangers of said creel portion, (c) starting a spinning operation while said bobbin carriage suspending said full packaged roving bobbins is carried to said supplemental rail and maintained at a working position thereof on said supplemental rail, (d) applying a unit roving bobbin exchange operation to almost exhausted roving bobbins (SB) when said almost half exhausted roving bobbins (MB) become almost exhausted roving bobbins (SB) and said full packaged roving bobbins (FB) become said half exhausted roving bobbins (MB), said unit roving bobbin exchanging operation exchanging almost exhausted roving bobbins (SB) supported by said pair of front and back bobbin hangers of said creel portion at said each side of said spinning frame with a pair of full packaged roving bobbins (FB) suspended by a corresponding pair of two adjacent bobbin hangers of said bobbin carriage, said unit operation being applied to all pairs of bobbin hangers supporting almost exhausted roving bobbins (SB) in said creel portion of each side of said spinning frame by means of a roving bobbin exchanging apparatus;

an improvement of said roving bobbin exchanging method comprising:

simultaneously applying said unit operation to a group of successive pairs of said bobbin hangers holding said almost exhausted roving bobbins (SB) groups being arranged from one side to the other side of said spinning frame along the lengthwise direction thereof;

said unit operation comprising:

(1) removing a pair of two full packaged roving bobbins (FB), from said bobbin hangers of said bobbin carriage located at a working position on said supplemental rail, which correspond to a pair of said front and back bobbin hangers supporting said almost exhausted roving bobbins (SB) in said creel portion of said spinning frame, and displacing said full packaged roving bobbins (FB) to predetermined positions on said roving exchanging apparatus along side said supplemental rail;

(2) changing a relative arrangement of said two full packaged roving bobbins (FB) from said row along said supplemental rail in a front and back relation perpendicular to said lengthwise direction of said spinning frame by displacing one of said full packaged roving bobbins to a predetermined position in another row which is one of (i) a front side and (ii) a back side position with respect to the other one of said full packaged roving bobbins;

(3) removing said almost exhausted roving bobbins (SB) from said corresponding pair of said front and back bobbin hangers of said creel portion and displacing said pair of almost exhausted roving bobbins (SB) to respective predetermined positions along side said row of said full packaged roving bobbins (FB) on said roving bobbin exchanging apparatus, while maintaining said front and back relationship of said two almost exhausted roving bobbins (SB);

(4) mounting said pair of full packaged roving bobbins (FB), displaced to said respective predetermined positions, on a corresponding one of said pair of front and back bobbin hangers from which said almost exhausted roving bobbins (SB) have been removed;

(5) changing the front-back relative arrangement of said two almost exhausted roving bobbins (SB) with respect to said arrangement along said supplemental rail by displacing one of said almost exhausted roving bobbins to either side of said almost exhausted roving bobbins, in said lengthwise direction of said spinning frame, while taking a position on said roving bobbin exchanging apparatus, and thereafter, mounting said pair of almost exhausted roving bobbins on corresponding bobbin hangers of said bobbin carriage.

2. A method of exchanging roving bobbins according to claim 1, wherein, said simultaneous unit operation is applied to three pairs of front and back bobbin hangers holding almost exhausted roving bobbins which form a part of said group of successive pairs of said bobbin hangers.

3. A method of exchanging roving bobbins according to claim 2, wherein, said bobbin carriage includes a supplemental bobbin hanger arranged, with said pitch (A2), on said bobbin carriage at a position in front of a bobbin hanger located at an end of said arrangement of said bobbin hangers in a direction opposite to a displacing direction of said roving bobbin exchanging apparatus along said spinning frame, during said step (1) of said unit operation, said pair of full packaged roving bobbins (FB) are displaced to said respective predetermined positions directly below said supplemental rail on said roving bobbin exchanging apparatus wherein one of said pair of full packaged roving bobbins (FB) faces said front bobbin hangers of said pair of bobbin hangers suspending said almost exhausted roving bobbins (SB) in a direction perpendicular to said lengthwise direction of said spinning frame, while the other one of said full packaged roving bobbins (FB) faces said front bobbin hangers of a pair of said front and back bobbin hangers suspending almost half exhausted roving bobbins (MB) located at a position along said pair of front and back bobbin hangers suspending said almost exhausted roving bobbins (SB), during said step (4) of said unit operation, said pair of full packaged roving bobbins (FB) and said pair of said almost exhausted roving bobbins (SB) positioned at said respective predetermined positions are simultaneously displaced by said pitch (A2) to either side of said spinning frame in the lengthwise direction thereof, while maintaining relative arrangement of said pairs of said full packaged roving bobbins (FB) and said almost exhausted roving bobbins (SB) whereby said pair of full packaged roving bobbins (FB) face said pair of front and back bobbin hangers from which said almost exhausted roving bobbins (SB) are removed, in said direction perpendicular to said lengthwise direction of said spinning frame, during said step (5) of said unit operation, one of said pair of almost exhausted roving bobbins (SB) positioned at a side of said spinning frame on said roving bobbin exchanging apparatus is kept in its position, another one of said pair of almost exhausted roving bobbins (SB) is horizontally displaced to a position on a line along said supplemental rail, at a side of simultaneously displacing said pair of full packaged roving bobbins (FB) and said pair of almost exhausted roving bobbins (SB), while axial distance between said almost exhausted roving bobbins (SB) is changed from (A3) to (A2), thereafter, said pair of almost exhausted roving bobbins (SB) are suspended by said pair of bobbin hangers of said bobbin carriage, which are positioned at respective positions biased from the respective positions of said pair of bobbin hangers from which said pair of full packaged roving bobbins (FB) have been removed, by a distance equal to said pitch (A2), in a direction opposite to a direction of said simultaneous displacement of said pair of full packaged roving bobbins (FB) and said pair of almost exhausted roving bobbins (SB).

4. A method of exchanging roving bobbins in a ring spinning frame, according to claim 3, wherein, during said step (4) of said unit operation, before simultaneously displacing said pair of full packaged roving bobbins (FB) and said pair of almost exhausted roving bobbins (SB) by said pitch (A2) in horizontal direction along said supplemental rail, a full packaged roving bobbin (FB), located at a position directly outside successive three pairs of bobbin hangers from which said full packaged roving bobbins (FB) have been removed, is displaced to a waiting position apart from a position directly below said supplemental rail, on said roving bobbin exchanging apparatus, and during said step (5) of said unit operation, when said pair of almost exhausted roving bobbins (SB) are displaced in a direction opposite to said horizontal displacement of thereof in said step (4) of said unit operation, said full packaged roving bobbin (FB) temporarily reserved at said waiting position is returned to said bobbin hanger of said bobbin carriage from which said full packaged roving bobbins (FB) was removed.

5. A method of exchanging roving bobbins in a ring spinning frame according to claim 3, wherein, during said step (4) of said unit operation, before simultaneously displacing said pair of full packaged roving bobbins (FB) and said pair of almost exhausted roving bobbins (SB) by said pitch (A2) towards said direction along said lengthwise direction of said spinning frame, said roving bobbin (SB), which is located at a side of said spinning frame in said pair of almost exhausted roving bobbins (SB), positioned at the displacing side in the simultaneous motion of said group formed by pairs of said full packaged roving bobbins (FB) and pairs of said almost exhausted roving bobbins, is temporarily reserved at a waiting position on said roving bobbin exchange apparatus, which is outside a position directly below said supplemental rail, during said step (5) of said unit operation, when said pair of almost exhausted roving bobbins (SB) are displaced to a direction reverse to said horizontal displacement of said pairs of full packaged roving bobbins and said pairs of almost exhausted roving bobbins along said supplemental rail by a distance identical to said pitch (A2), said almost exhausted roving bobbins (SB), reserved at said waiting position, is returned to said position before reserving at said waiting position.

6. A method of exchanging roving bobbins according to claim 1, wherein, during said step (2) of said unit operation wherein said relative arrangement of said pair of full packaged roving bobbins (FB), taken from said bobbin carriage, along said supplemental rail is changed to said relative arrangement of said pair of full packaged roving bobbins (FB) in a direction perpendicular to said lengthwise direction of said spinning frame, an axial distance between said pair of full packaged roving bobbins (FB) is changed from said pitch (A2) to a pitch (A3), and during said step (5) of said unit operation wherein said relative arrangement of said pair of almost exhausted roving bobbins (SB) taken from said corresponding pair of front and back bobbin hangers is changed in said direction perpendicular to said lengthwise direction changes direction along said supplemental rail said axial distance between said two almost exhausted roving bobbins SB is changed from said pitch (A3) to said distance (A2).

7. A method of exchanging roving bobbins according to claim 1, wherein, during said step (3) of said unit operation, a free leading end of a roving is taken from each one of said full packaged roving bobbins (FB) positioned on said respective predetermined positions on said roving bobbin exchanging apparatus, before removing said pair of roving bobbins (SB) from the corresponding pair of front and back bobbin hangers of said creel portion of said spinning frame, and said free leading end of the roving is pieced with a corresponding roving which is fed from one of said almost exhausted roving bobbins to a corresponding one of said draft parts of said spinning frame.

8. A method of exchanging roving bobbins according to claim 1, wherein, during said step (1) of said unit operation, said pair of full packaged roving bobbins (FB) are displaced to respective predetermined positions directly below said supplemental rail on said roving bobbin exchanging apparatus such that one of said pair of full packaged roving bobbins (FB) faces said front bobbin hanger of said pair of bobbin hangers suspending said almost exhausted roving bobbins (SB) in a direction perpendicular to said lengthwise direction of said spinning frame, while the other one of said full packaged roving bobbins (FB) face said almost bobbin hangers of a pair of said front and back bobbin hangers suspending almost half exhausted roving bobbins (MB) located a position along side said pair of front and back bobbin hangers suspending said almost exhausted roving bobbins (SB), during said step (4) of said unit operation, said pair of full packaged roving bobbins (FB) and said pair of said almost exhausted roving bobbins (SB) positioned at said respective predetermined positions are simultaneously displaced by said pitch (A2) to either side of said spinning frame in the lengthwise direction thereof, while maintaining relative arrangement of said pairs of said full packaged roving bobbins (FB) and said almost exhausted roving bobbins (SB), whereby said pair of full packaged roving bobbins (FB) face said pair of front and back bobbin hangers from which said almost exhausted roving bobbins (SB) are removed, in said direction perpendicular to said lengthwise direction of said spinning frame, and during said step (5) of said unit operation, before changing relative arrangement of said almost exhausted roving bobbins (SB) to said arrangement along said supplemental rail, said pair of almost exhausted roving bobbins are simultaneously displaced by said pitch (A2) in a direction opposite to the horizontal displacement thereof, without changing the relative positions of said pair of almost exhausted roving bobbins.

9. A method of exchanging roving bobbins in a ring spinning frame according to claim 1, wherein, during said step (4) of said simultaneous unit operations, when said unit operation is applied to a first group of successive pairs of said bobbin hangers located at one side of said spinning frame along the lengthwise direction thereof, before simultaneously displacing said pairs of full packaged roving bobbins (FB) and said pairs of almost exhausted roving bobbins toward either direction along said supplemental rail at a group, said roving bobbin (SB) located at a side of said spinning frame in said pair of almost exhausted roving bobbins (SB), which are a pair of roving bobbins (SB) located at the displacing side of said group of said pairs of roving bobbins (FB) and (SB), is temporarily reserved at a waiting position on said roving bobbin exchanging apparatus, which is outside a position directly below said supplemental rail, and after completion of said unit operation applied to a last group of said pairs of said bobbin hangers located at an other side of said spinning frame, said reserved roving bobbin (SB) is displaced to a remaining one of said bobbin hangers of said bobbin carriage, which is free to receive said almost exhausted roving bobbin of said bobbin carriage.

10. A method of exchanging roving bobbins applied to a ring spinning frame according to claim 1, wherein, said simultaneous unit operations are successively applied to said group pairs of said front and back bobbin hangers of said creel portion of said spinning frame, suspending almost exhausted roving bobbins from one end side to the other end side of said spinning frame, during first simultaneous unit operations applied to a first group of pairs of said front and back bobbin hangers, in said step (1) of said unit operation, said pair of full packaged roving bobbins (FB) are removed from said two adjacent bobbin hangers of said bobbin carriage and displaced to the respective predetermined positions directly under said supplemental rail on said roving bobbin exchanging apparatus wherein one of said full packaged roving bobbins (FB) faces said front bobbin hanger of said pair of front and back bobbin hangers suspending said almost exhausted roving bobbin (SB) in a direction perpendicular to said lengthwise direction of said spinning frame, while an other one of said full packaged roving bobbins (FB) faces said front bobbin changer of a pair of said front and back bobbin hangers suspending almost half exhausted roving bobbins (MB) at a position along side said pair of front and back bobbin hangers suspending said almost exhausted roving bobbins (SB), in said step (4) of said unit operation, said pair of full packaged roving bobbin (FB) and said pair of almost exhausted roving bobbins (SB) are horizontally displaced by said pitch (A2) in either direction along said lengthwise direction of said spinning frame, without changing relative positions of said full packaged roving bobbins (FB) and said almost exhausted roving bobbins (SB) so that said pair of full packaged roving bobbins (FB) face said pair of front and back bobbin hangers of said creel portion of said spinning frame from which said pair of almost exhausted roving bobbins were removed, thereafter, said pair of full packaged roving bobbins (FB) are mounted on sid bobbin hangers respectively, in said step (5) of said unit operation, one of said roving bobbins (SB) which is located at a front side of the other one of said roving bobbins (SB) which faces said spinning frame, is horizontally displaced to a position along side said almost exhausted roving bobbin (SB) which faces said spinning frame in a direction along said supplemental rail, while displacing said pair of almost exhausted roving bobbins (SB) by said pair of full packaged roving bobbins (FB) and said pitch (A2) in a direction opposite to said horizontal displacement of said pair of almost exhausted roving bobbins (SB) during said step (5) of said unit operation, during second simultaneous unit operation, in said step (4) of said unit operation, before horizontally displacing said pair of full packaged roving bobbins (FB) and said pair of almost exhausted roving bobbins (SB) by said pitch (A2), towards a direction opposite to a direction of processing a successive simultaneous operations, said almost exhausted roving bobbins SB suspended by said bobbin hanger of said bobbin carriage, which is located at a side of a group of bobbin hangers in a direction to which said first simultaneous unit operation was already completed, is taken from said bobbin hanger and temporarily reserved at a position on said roving bobbin exchanging apparatus, said position is separated from a position directly below said supplemental rail, in successive simultaneous unit operations, during said step (4) of said unit operation, said pair of full packaged roving bobbins (FB) and said pair of said almost exhausted roving bobbins (SB) positioned at said respective predetermined positions are simultaneously displaced by said pitch (A2) to either side of said spinning frame in the lengthwise direction thereof, while maintaining relative arrangement of said pairs of said full packaged roving bobbins (FB) and said almost exhausted roving bobbins (SB), whereby said pair of full packaged roving bobbins (FB) face said pair of front and back bobbin hangers from which said almost exhausted roving bobbins (SB) are removed, in said direction perpendicular to said lengthwise direction of said spinning frame, during said step (5) of said unit operation, one of said pair of almost exhausted roving bobbins (SB) positioned at a side of said spinning frame on said roving bobbin exchanging apparatus is kept in its position, and another one of said pair of almost exhausted roving bobbins (SB) is displaced to a position on a line along said supplemental rail at a side of simultaneously displacing said pair of full packaged roving bobbins (FB) and said pair of almost exhausted roving bobbins (SB), while axial distance between said almost exhausted roving bobbins (SB) is changed from (A3) to (A2), thereafter, said pair of almost exhausted roving bobbins (SB) are suspended by said pair of bobbin hangers of said bobbin carriage, which are positioned at respective positions biased from the respective positions of said pair of bobbin hangers from which said pair of full packaged roving bobbins (FB) have been taken off, by a distance equal to said pitch (A2), in a direction opposite to a direction of said simultaneous displacement of said pair of full packaged roving bobbins (FB) and said pair of almost exhausted roving bobbins (SB), after completion of said simultaneous unit operations applied to said group of successive pairs of said bobbin hangers of said spinning frame located at said other side of said spinning frame, said almost exhausted roving bobbins (SB), which is reserved on said roving bobbin exchanging apparatus, is mounted n the remaining one of said bobbin hangers of said bobbin carriage which is free for receiving said almost exhausted roving bobbin (SB).

11. In an apparatus for exchanging roving bobbins for a ring spinning frame provided with a plurality of draft parts arranged in an alignment along a lengthwise direction at each side of said spinning frame; wherein an inner-side and an outer-side of said spinning frame define a back-side and a front-side of said spinning frame, respectively;

a creel portion including front and back rows of bobbin hangers arranged along said alignment of draft parts at each side of said spinning frame having an identical pitch (A2) between two adjacent bobbin hangers in each row of said bobbin hangers and a distance (A3) between said front and back rows of bobbin hangers so that plural pairs of bobbin hangers are provided, wherein each pair is formed by a front bobbin hanger of said front row of bobbin hangers and a back bobbin hanger of said back row of bobbin hangers facing said front bobbin hanger in a direction perpendicular to said lengthwise direction of said spinning frame;

a supplemental rail arranged along the two rows of bobbin hangers at each side of said spinning frame for receiving a bobbin carriage provided with a plurality of bobbin hangers arranged in a row having a pitch equal to said pitch (A2), wherein a spinning operation is started after alternately suspending full packaged roving bobbins (FB) by said respective pairs of said bobbin hangers and suspending almost half exhausted roving bobbins (MB) by remaining pairs of said bobbin hangers, said apparatus including means for performing a unit operation of exchanging almost exhausted roving bobbins (SB) when said almost half exhausted roving bobbins (MB) suspended by said pairs of front and back bobbin hangers of said creel portion become almost exhausted, with said full packaged roving bobbins (FB) of said bobbin carriage respectively; a mechanism for intermittently displacing a main body along a lengthwise direction of said spinning frame to carry out said roving bobbin exchanging operation from one end side to another end side of said spinning operation;

an improvement comprising;

a group of pairs of roving bobbin holding members comprising a first peg unit provided with a pair of pegs for holding said full packaged roving bobbins (FB) and a second peg unit provided with a pair of pegs for holding said almost exhausted roving bobbins (SB), arranged on said main body such that said first peg units and said second peg units are alternately arranged on said main body along a lengthwise direction of said main body with a pitch equal to said pitch (A2);

means for reciprocally displacing said group of pairs of roving bobbin holding members together with said main body by a distance equal to said pitch (A2) along a lengthwise direction of said spinning frame, so as to maintain relative positions of said pegs of said first peg units and said second peg units of said group of pairs of said roving bobbin holding members, during said unit operation of said roving bobbin exchanging apparatus;

position setting means for setting positions for said pegs of said first and second peg units of said group of pairs of said roving bobbin holding members under conditions that (1) an axial distance between said pair of pegs of each first peg unit of said group of pairs and an axial distance between said pair of pegs of each second peg unit of said group of pairs are changed between a distance equal to said pitch (A2) and a distance equal to said pitch (A3), respectively, (2) planes passing through an axis of aid pair of said pegs of each first peg unit of said group and an axis of each second peg unit of said group are separately changed between said lengthwise direction of said spinning frame and a direction perpendicular to said lengthwise direction of said spinning frame, and (3) said pair of pegs of each first peg unit of said group of pairs and said pair of pegs of each second peg unit of said group of pairs are separately displaced between respective positions on said main body and positions directly below a respective one of a corresponding pair of said front and back bobbin hangers of said creel to said spinning frame; and means for lifting said first peg unit of said group and said second peg unit of said group between respective elevated levels, wherein said full packaged roving bobbins (FB) are transferred from said bobbin hangers of said bobbin carriage to corresponding pegs of said first peg units of said group of pairs, while said full packaged roving bobbins (FB) are transferred from said pegs of said first peg units of said group of pairs to respective pegs of corresponding pairs of said front bobbin hangers and back bobbin hangers, and said almost exhausted roving bobbins (SB) are transferred from said pairs of said front and back bobbin hangers to respective pegs of a corresponding second peg unit of said group of pairs, while said almost exhausted roving bobbins (SB) are transferred from respective pegs of said second peg units of said group pairs to respective bobbin hangers of corresponding pairs of said bobbin carriage, and lowered to levels thereof fixed on said main body.

12. A roving bobbin exchanging apparats according to claim 1, further comprising:

means for catching a leading free end of a roving from said full packaged roving bobbin mounted on each one of said pegs of each peg unit of said group which takes a position in said direction perpendicular to said lengthwise direction of said spinning frame with a pitch between said two pegs equal to said pitch (A3), at a time directly before displacing said pair of pegs of each first peg unit of said group of pairs into respective positions directly below said creel portion of said spinning frame, and means for introducing the caught leading free end of said roving to a position for doubling with respective rovings being supplied from a corresponding one of almost exhausted roving bobbins, which are still suspended by a corresponding one of said pair of said front and back bobbin hangers of said creel portion, into corresponding draft parts of said spinning frame.

13. An improved roving bobbin exchanging apparatus according to claim 11, wherein said first peg unit of each pair of roving bobbin holding members comprises:

a first member displaceably mounted on said means for lifting displaced along a direction perpendicular to the lengthwise direction of said spinning frame, a second member displaceably mounted on said first member displaced along said direction perpendicular to the lengthwise direction of said spinning frame on said first member, a third member displaceably supported by said second member at an end portion thereof which is opposite to said spinning frame such that an intervening distance between said second member and said third member is variable by displacing said third member in relation to said second member, said third member including a vertical shaft secured thereon, a horizontal swing arm rotatably mounted on one end portion thereof to said vertical shaft of said third member, means for changing said distance between said second member and said third member, means for turning said swing arm about said vertical shaft of said third member for 90 degrees between said direction along said lengthwise direction of said spinning frame and said direction perpendicular to said lengthwise direction of said spinning frame, and means for displacing said second member relatively to said first member along said direction perpendicular to said lengthwise direction of said spinning frame, wherein one of said pair of pegs for holding said full packaged roving bobbins is rotatably mounted on a free end portion of said second member, while an other of said pair of pegs is rotatably mounted on a free end portion of said horizontal swing arm; and a second peg unit of each pair of roving bobbin holding members being identical to said first peg units except that, the third member of said second peg unit is formed with the second member of said second peg unit as one body so that the mechanism of said first peg unit for changing said distance between said second member and said third member is omitted in said second peg unit.

14. An improved roving bobbin exchanging apparatus according to claim 13, wherein said position setting means comprises:

means for relatively displacing said first member of said first peg unit to a base member along said direction perpendicular to said lengthwise direction of said spinning frame in a direction perpendicular to said lengthwise direction of said spinning frame, in combination with said means for displacing said second member relatively to said first member of said first peg unit, and a means for displacing said first member of said second peg unit relatively to said means for lifting, in combination with said means for displacing said second member of said second peg unit.

15. An improved roving bobbin exchanging apparatus according to claim 13, wherein said first and second peg units are provided with a means for rotating said peg mounted on said second member and means for rotating said peg mounted on said swing arm, and said second peg unit is further provided with means for rotating said peg mounted on said second member and means for rotating said peg mounted on said swing arm.

16. An improved roving bobbin holding apparatus according to claim 13, wherein said group of pairs of roving bobbin holding members comprises three pairs of said roving bobbin holding members, and said first roving bobbin holding members and said second roving bobbin holding members are alternately arranged on a base member along said lengthwise direction of said apparatus with a pitch equal to said pitch (A2).

17. An improved roving bobbin exchange apparatus according to claim 11, further comprising:

a supplemental peg mounted on said main body of said roving bobbin exchanging apparatus at a position separate from a position directly below said supplemental rail; and means for transferring an almost exhausted roving bobbin (SB), which was transferred to one of said bobbin hangers of said bobbin carriage by a previous unit operation of said roving bobbin exchanging apparatus and has taken up a position which is in close proximity to the means for performing said unit operation, between said supplemental peg.

18. An improved roving bobbin exchanging apparatus according to claim 11, further comprising:

a supplemental peg mounted on a position separate from a position directly below said supplemental rail, means for transferring said almost exhausted roving bobbin (SB) mounted on said peg of said second peg unit, taking a position which is at a side of said group of pairs of roving bobbin holding members at a displacing side of said roving bobbin exchanging apparatus for successive unit operations of said apparatus, between said supplemental rail.

* * * * *